US006211623B1

(12) United States Patent
Wilhelm et al.

(10) Patent No.: US 6,211,623 B1
(45) Date of Patent: Apr. 3, 2001

(54) FULLY INTEGRATED BALLAST IC

(75) Inventors: Dana S. Wilhelm, Temple City; Talbott M. Houk, Monte Sereno; Thomas J. Ribarich, Laguna Beach, all of CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 09/225,635

(22) Filed: Jan. 5, 1999

Related U.S. Application Data

(63) Continuation-in-part of application No. 09/095,062, filed on Jun. 10, 1998, and a continuation-in-part of application No. 09/122,699, filed on Jul. 27, 1998, now Pat. No. 5,973,943

(60) Provisional application No. 60/070,495, filed on Jan. 5, 1998, provisional application No. 60/071,482, filed on Jan. 13, 1998, provisional application No. 60/079,250, filed on Mar. 25, 1998, provisional application No. 60/079,251, filed on Mar. 25, 1998, provisional application No. 60/079,487, filed on Mar. 26, 1998, provisional application No. 60/079,492, filed on Mar. 26, 1998, and provisional application No. 60/079,493, filed on Mar. 26, 1998.

(51) Int. Cl.[7] ..... H05B 37/02

(52) U.S. Cl. ..... 315/224; 315/291; 315/307; 315/308

(58) Field of Search ..... 315/224, 291, 315/209 R, 307, 308, 347, DIG. 5, DIG. 7, 91, 27

(56) References Cited

U.S. PATENT DOCUMENTS

| | | | | |
|---|---|---|---|---|
| 4,933,798 | * | 6/1990 | Widmayer et al. | 361/18 |
| 5,049,790 | | 9/1991 | Herfurth et al. | 315/291 |
| 5,315,214 | * | 5/1994 | Lessea | 315/209 R |
| 5,373,435 | * | 12/1994 | Jayaraman et al. | 363/98 |
| 5,550,433 | * | 8/1996 | Tobler | 315/94 |
| 5,699,238 | | 12/1997 | Lee et al. | 363/21 |
| 5,705,894 | * | 1/1998 | Krummel | 315/119 |
| 5,811,941 | * | 9/1998 | Barton | 315/307 |
| 5,982,110 | * | 11/1999 | Gradzki | 315/247 |

FOREIGN PATENT DOCUMENTS

| | | |
|---|---|---|
| 0399613 | 11/1990 | (EP) . |
| WO9325952 | 12/1993 | (WO) . |
| WO9743878 | 11/1997 | (WO) . |
| WO9846053 | 10/1998 | (WO) . |

* cited by examiner

*Primary Examiner*—Don Wong
*Assistant Examiner*—Ephrem Alemu
(74) *Attorney, Agent, or Firm*—Ostrolenk, Faber, Gerb & Soffen, LLP

(57) ABSTRACT

A ballast controller integrated circuit which executes a specific set of instructions via an integrated state diagram architecture to control the fluorescent lamp and protect the ballast. The state diagram architecture controls powering up and down of the IC and the half-bridge circuit driven by the IC, preheating and striking of the lamp, running of the lamp, sensing for numerous possible fault conditions, and recovering from these fault conditions based on the normal maintenance of a lamp.

12 Claims, 10 Drawing Sheets

FIG. 7
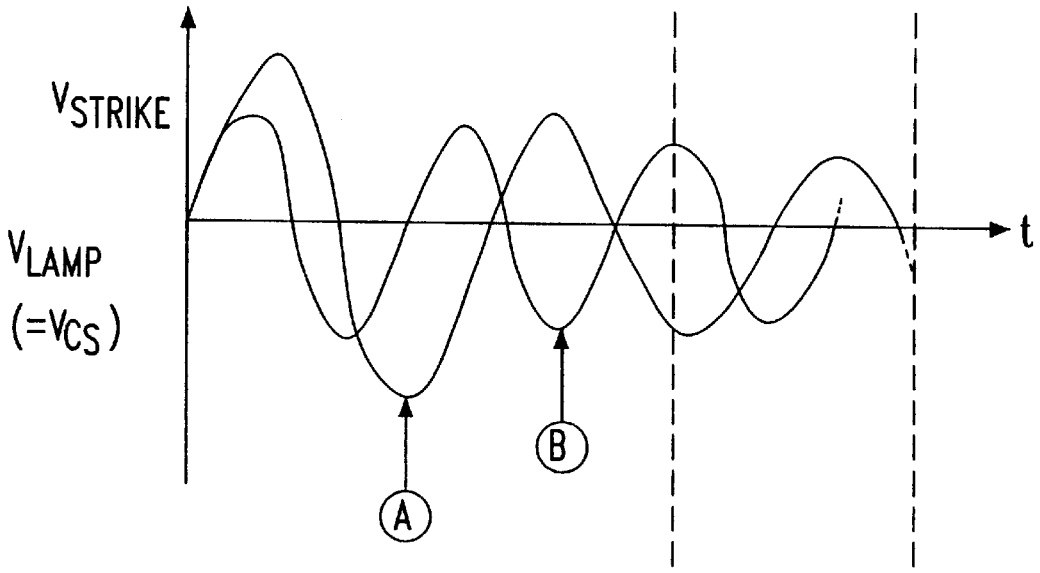
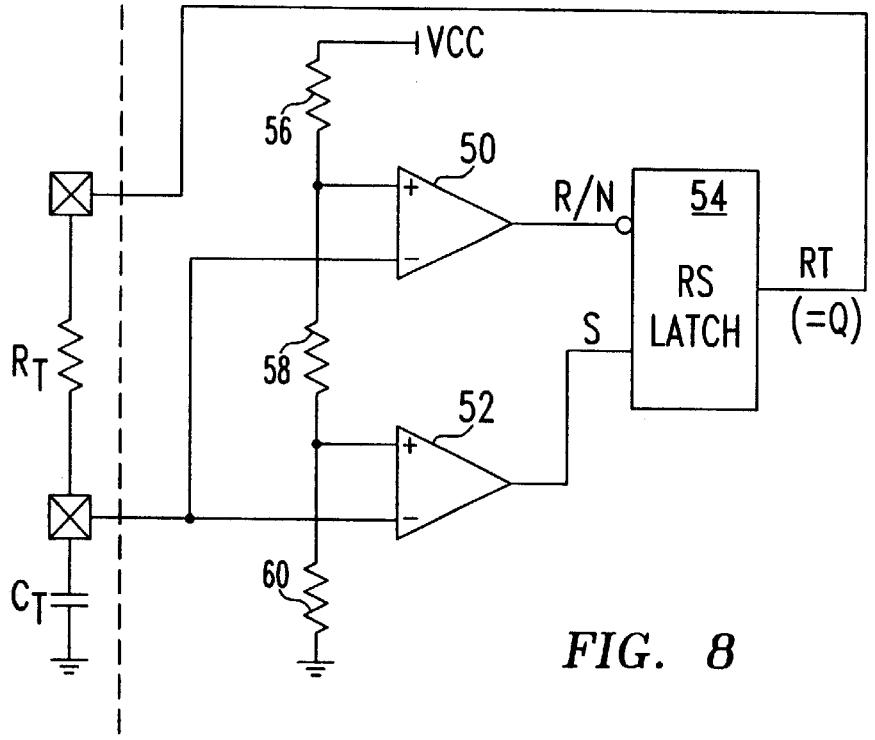
FIG. 8

FULLY INTEGRATED BALLAST IC

This application is a continuation-in-part of U.S. application Ser. No. 09/095,062 filed Jun. 10, 1998 and U.S. application Ser. No. 09/122,699 filed on Jul. 27, 1998 now U.S. Pat. No. 5,973,943 issued Oct. 26, 1999, and claims the benefit of U.S. Provisional Application Ser. No. 60/070,495, filed on Jan. 5, 1998, U.S. Provisional Application Ser. No. 60/071,482, filed Jan. 13, 1998, U.S. Provisional Application Ser. No. 60/079,250, filed on Mar. 25, 1998, U.S. Provisional Application Ser. No. 60/079,251, filed on Mar. 25, 1998, U.S. Provisional Application Ser. No. 60/079,487, filed on Mar. 26, 1998, U.S. Provisional Application Ser. No. 60/079,492, filed on Mar. 26, 1998, and U.S. Provisional Application Ser. No. 60/079,493, filed on Mar. 26, 1998.

BACKGROUND OF THE INVENTION

1. Field of the Invention

The present invention relates to a gate driver circuit for MOS gated devices, and more specifically to a monolithic gate driver circuit for MOS gated devices, particularly those used in fluorescent lamp ballast circuits.

2. Description of the Related Art

Electronic ballasts for gas discharge circuits have recently come into widespread use because of the availability of power MOSFET switching devices and insulated gate bipolar transistors ("IGBTs") to replace previously used power bipolar switching devices. Monolithic gate driver circuits, such as the IR2155 sold by International Rectifier Corporation and described in U.S. Pat. No. 5,545,955, the disclosure of which is incorporated herein by reference in its entirety, have been devised for driving the power MOSFETs or IGBTs in electronic ballasts. The IR2155 gate driver IC offers significant advantages over prior circuits in that it is packaged in a conventional DIP or SOIC package and contains internal level shifting circuitry, under voltage lockout circuitry, deadtime delay circuitry, and additional logic circuitry and inputs so that the driver can self-oscillate at a frequency determined by external resistors $R_T$ and capacitors $C_T$.

Although the IR2155 offers a vast improvement over prior ballast control circuits, it lacks a number of desirable features such as: (i) a start-up procedure which ensures a flash-free start without an initial high voltage pulse across the lamp, (ii) non-zero voltage switching protection circuitry, (iii) over temperature shutdown circuitry, (iv) DC bus and AC on/off control circuitry, and (v) near or below resonance detection circuitry.

SUMMARY OF THE INVENTION

The present invention provides a novel monolithic electronic ballast controller IC which permits the driving of two MOS gated power semiconductors such as power MOSFETs or IGBTs, one designated as a "low side switch," the other designated as a "high side switch," the two switches being connected in a totem pole or half-bridge arrangement. Advantageously, the IC of the present invention executes a very specific set of instructions to control the fluorescent lamp and protect the ballast. Careful attention is paid to properly powering up and down the IC and the half-bridge, preheating and striking the lamp, running the lamp, sensing for numerous possible fault conditions, and recovering from these fault conditions based on the normal maintenance of a lamp.

The electronic ballast IC of the present invention (identified as the IR2157 by the assignee, International Rectifier Corporation) is designed to function in five basic modes of operation based upon the status of the various inputs to the IC. These 5 modes of operation include:

1) an under voltage lockout mode
2) a preheat mode
3) an ignition ramp mode
4) a run mode; and
5) a fault mode.

The circuitry is designed to switch between these modes in accordance with a "state diagram" and is additionally designed to ensure a flash-free start without an initial high voltage pulse across the lamp and to cleanly shutdown the IC upon the occurrence of non-zero voltage switching, an over temperature condition, a fault in the DC bus or AC line voltage, or in the event of a near or below resonance condition.

Other features and advantages of the present invention will become apparent from the following description of the invention which refers to the accompanying drawings.

BRIEF DESCRIPTION OF THE DRAWINGS

FIG. 7 shows the voltage across the lamp at start-up, both with (waveform A) and without (waveform B) an additional external resistor and capacitor to initially raise the frequency prior to pre-heat.

FIG. 8 illustrates the oscillator portion of the prior art IR2155 ballast driver IC.

DETAILED DESCRIPTION OF THE PREFERRED EMBODIMENT

Figure 1:
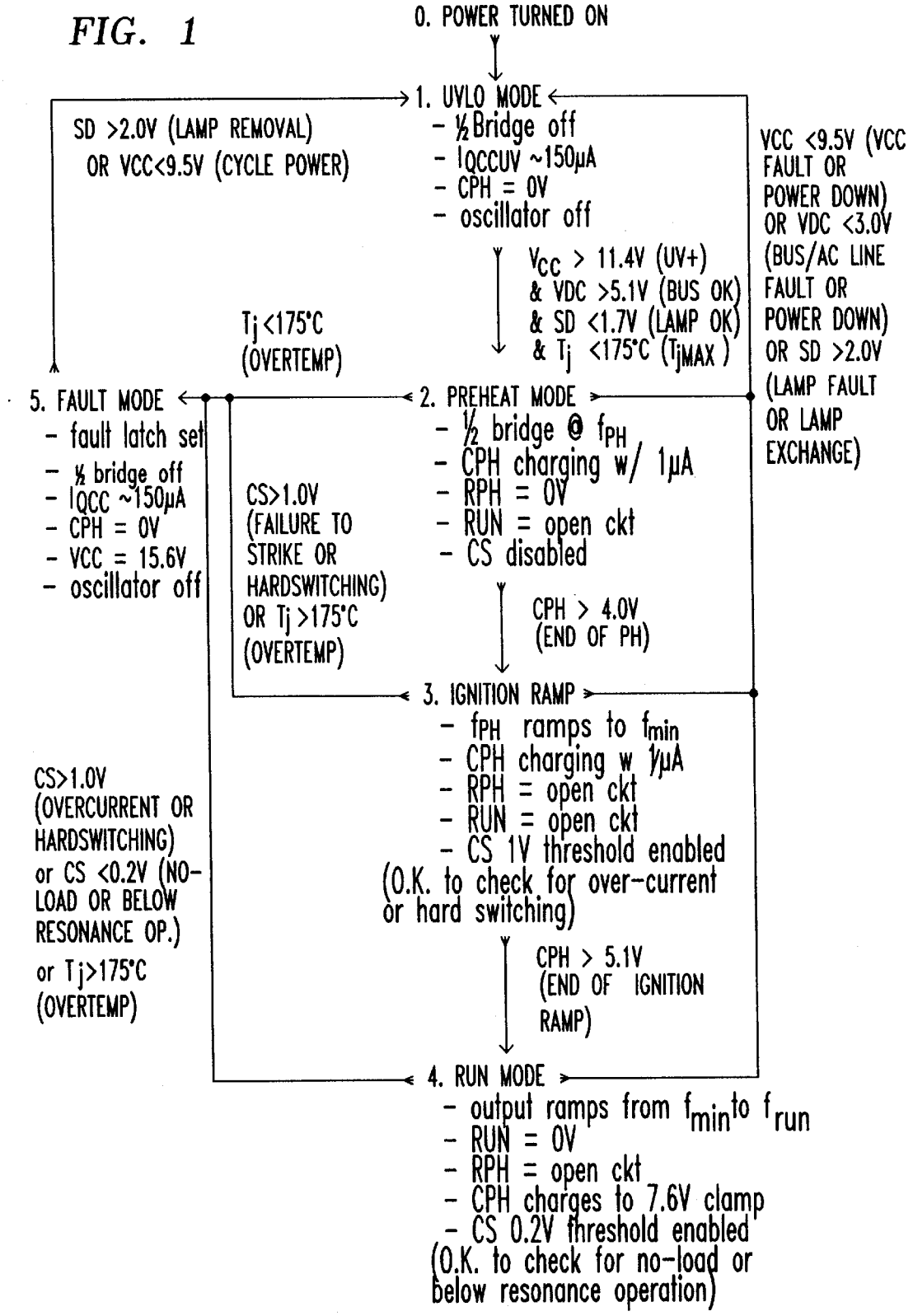
FIG. 1 is a state diagram which shows the operation of the integrated circuit of the present invention.
Figure 2:
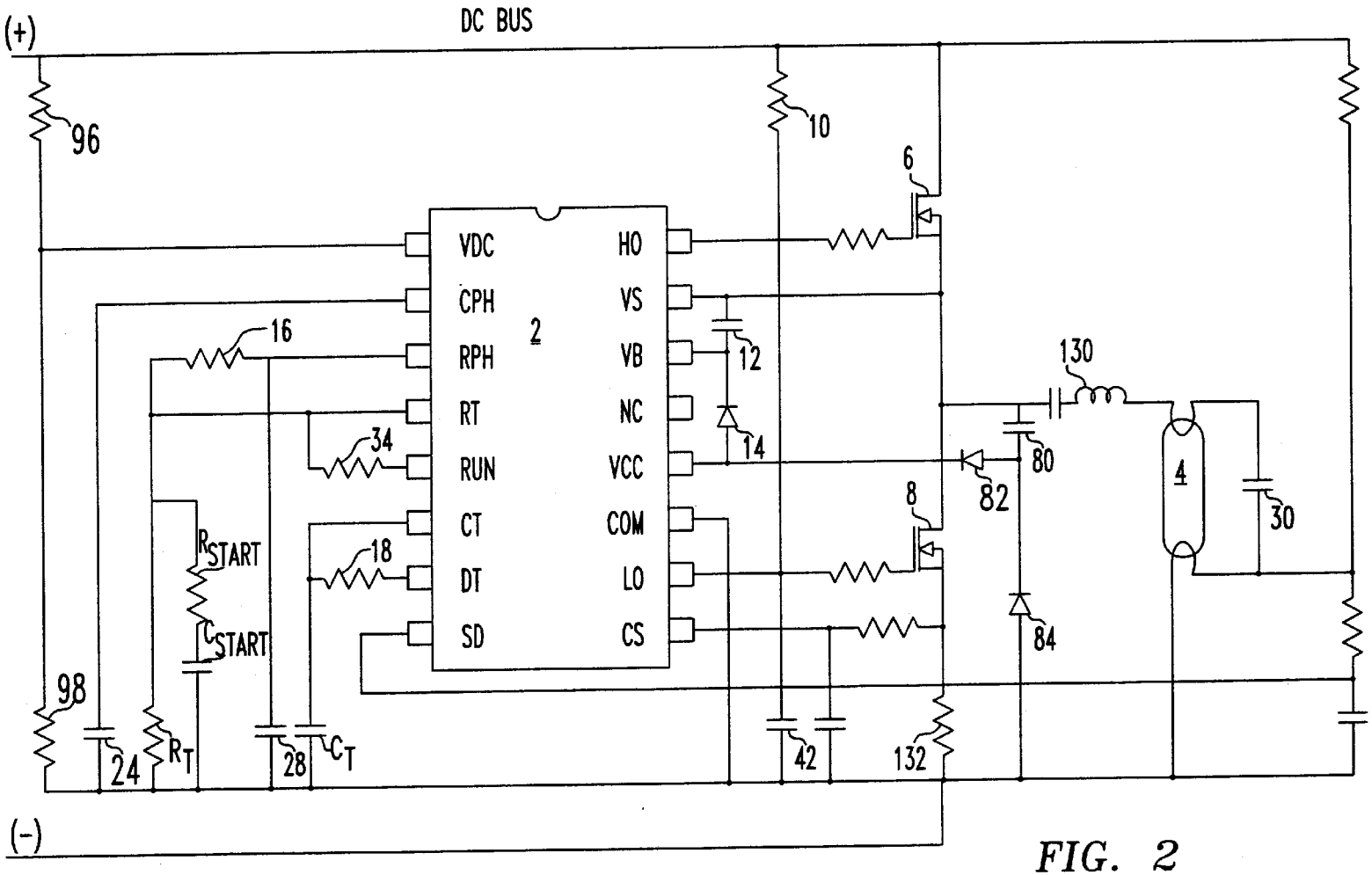
FIG. 2 illustrates a typical connection diagram for the integrated circuit of the present invention.
Figure 3:
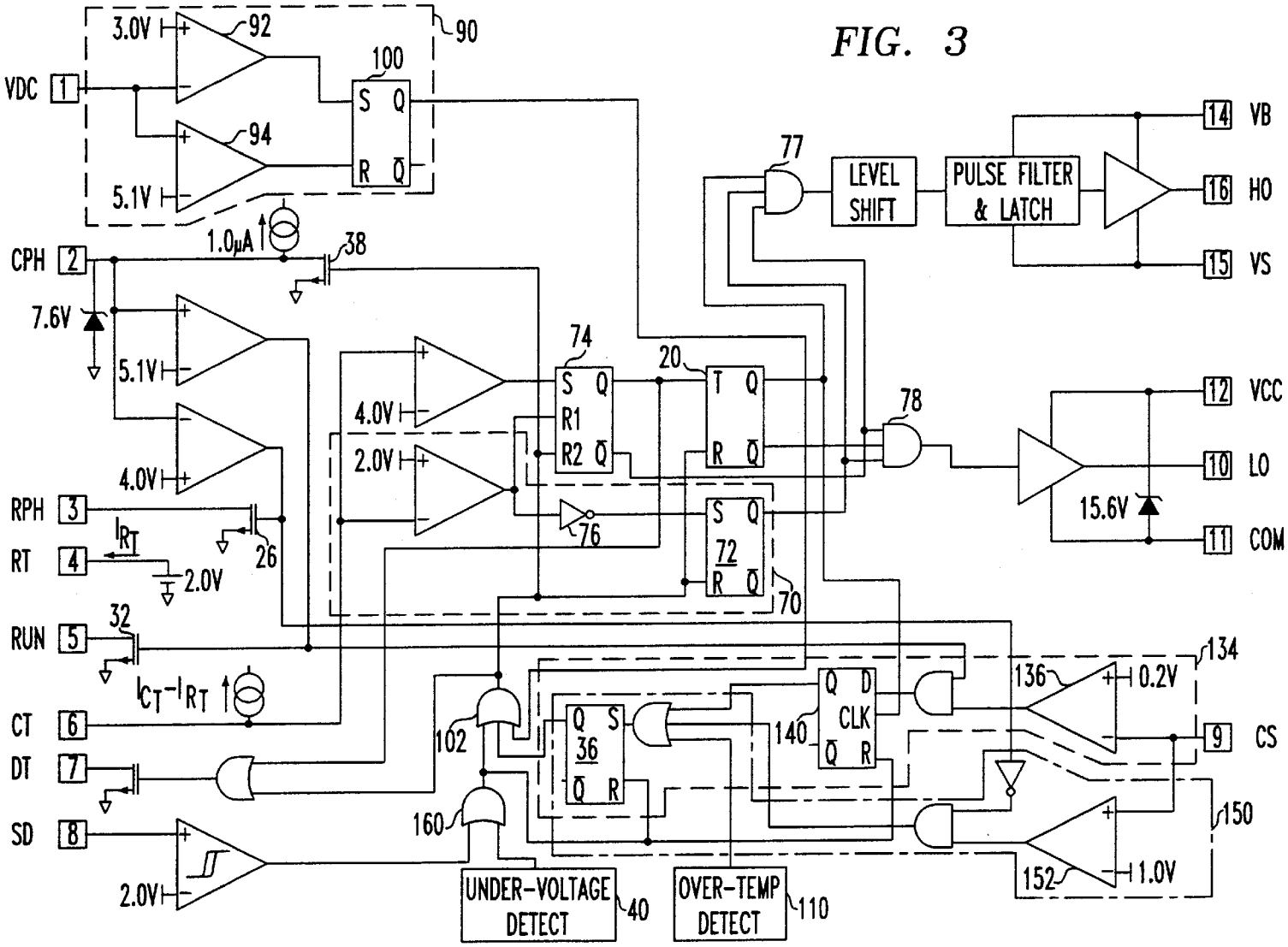
FIG. 3 is a block diagram of the circuitry of the integrated circuit of the present invention.

Referring first to FIG. 1, a state diagram is shown which is integrated into the integrated circuit (IC) 2 of the present invention to control an electronic (rapid start) fluorescent lamp ballast. FIG. 2 illustrates a typical connection diagram for driving a single fluorescent lamp 4 with the integrated circuit 2 of the present invention. FIG. 3 illustrates a basic block diagram of the integrated circuit 2 of the present invention.

In accordance with its "state diagram" architecture, the integrated circuit 2 of the present invention advantageously executes a very specific set of instructions to control the lamp 4 and protect the ballast. The IC accurately controls and properly performs the functions of: powering up and down the IC 2 and the half-bridge (MOSFETs 6 and 8); preheating and striking the lamp; running the lamp; sensing for numerous possible fault conditions; and recovering from these fault conditions based on normal lamp maintenance.

The state machine operates between five basic modes of operation based on the status of the various inputs to the IC. These five modes of operation include:

1) under voltage lockout mode;
2) preheat mode;
3) ignition ramp mode;
4) run mode; and
5) fault mode.

FIG. 2 illustrates the pinouts of the IC 2, including all of its inputs and outputs.

The inputs to the chip include:

1) VCC
2) VDC
3) SD
4) CS
5) CPH
6) CT
7) RT

VCC represents both an input to be sensed and the primary low voltage supply to the IC. In addition to these seven inputs, the IC surface junction temperature represents an eighth input.

The outputs of the IC include:

1) HO
2) LO
3) RPH
4) RUN
5) DT

The supplies to the IC include:

1) VCC
2) COM
3) VB
4) VS

The general pin descriptions for the IC of the present invention are as follows:

| Lead | |
|---|---|
| Symbol | Description |
| VCC | Logic and Internal Gate Drive Supply Voltage. A 15.6V internal zener diode clamps the voltage between VCC and COM. VCC should be bypassed to COM as close to the IC terminals as possible with a low ESR/ESL capacitor. A rule of thumb for thc value of this bypass capacitor is to keep its minimum value at least 2500 times the value of the total input capacitance (Ciss) of the power transistors being driven. This decoupling capcitor can be split between a higher valued electrolytic and a lower valued ceramic connected in parallel, although a good quality electrolytic will work well. In a typical application circuit, the supply voltage to the IC is normally derived by means of a high value startup resistor (1/4W) from the rectified line voltage, in combination with a charge pump from the output of the half-bridge. With this type of supply arrangement, the internal zener clamp diode will determine the nominal IC supply voltage. |
| COM | IC Power and Signal Ground. Both the low power control circuitry and low side gate driver output stage grounds return to this pin within the IC. The COM pin should be connected to the source of the low side power MOSFET using a single, separate pc board trace to avoid the possibility of high current ground loops interfering with sensitive timing component currents. In addition, the ground return path of the timing components and VCC decoupling capacitor should be connected directly to the IC COM pin, and not via separate traces or jumpers to other ground traces on the board. This allows the entire control circuit to reject the common-mode noise generated during output current switching. |
| RT | Oscillator Timing Resistor Input. The oscillator in the IR2157 resembles oscillators found in many popular PWM voltage regulator ICs and consists of a timing resistor and capacitor connected to ground. The voltage across the timing capacitor ($C_4$) is a sawtooth, where the rising portion of the ramp is determined by the current in the $R_T$ pin, and the falling portion of the ramp is determined by an external deadtime resistor (RDT). The $R_T$ input is a voltage-controlled current source, where the voltage is regulated to be approximately 2.0V. During the ignition mode of the ballast, the RT pin current and the timing capacitor charging current are both approximately: $$I_{CT} = I_{KT} = \frac{2.0\,\mathrm{V}}{\mathrm{RT}}$$ During the preheat mode of the ballast, the preheat resistor RPH is connected in parallel with the timing resistor $R_T$. Also during the run mode of the ballast, the run resistor RRUN is connected in parallel with the timing resistor $R_T$. In both of these mode, the charging current for the timing capacitor, as well as the output frequency are increased. In order to maintain proper linearity between the $R_T$ pin current and $C_T$ capacitor charging current, the value of the $R_T$ pin current should be kept between 50 $\mu$A. The $R_T$ pin can also be used as a feedback point for closed loop control. When the IC is in either an under voltage lockout or fault mode (shutdown, over current, under current or over temperature), the internal supply to the $R_T$ pin circuitry is shut off, and the $R_T$ pin is pulled down to COM by the external timing resistor. |
| CT | Oscillator Timing Capacitor Input. A capacitor connected from this pin to COM, along with the value |

-continued

| Lead | |
|---|---|
| Symbol | Description |
| | of the $Rp_T$ resistor, programs the oscillator ignition mode running frequency, according to the following formulas: $$f = \frac{1}{2(R_T C_T + td)}, \text{ or,}$$ $$C_T = \frac{1}{R_T}\left(\frac{1}{2f} - td\right),$$ $$\text{or, } R_T = \frac{1}{C_T}\left(\frac{1}{2f} - td\right)$$ where td is the deadtime. When the IC is in either an under voltage lockout or fault mode (shutdown, over current, under current or over temperature), the CT pin is shorted to COM through the deadtime resistor ($R_{DT}$). |
| DT | Deadtime programming pin. A resistor connected from the DT pin to the CT pin programs the fall time of the oscillator ramp waveform. This fall time represents the deadtime between the high-side and low-side gate driver outputs, and can be calculated using the following formulas: $$td = 0.69 R_{DT} \cdot C_T, \text{ or } R_{DT} = \frac{1.44 \cdot td}{C_T}$$ The deadtime is not a function of the $R_T$ resistor value. |
| RPH | Preheat Resistor and Ignition Capacitor Pin. The RPH pin is internally connected to the drain of an NMOS pulldown transistor. Normally a resistor ($R_{PH}$) is connected from the RPH pin to the RT pin, and a capacitor ($C_{IGN}$) is connected from RPH to COM. During the preheat mode, when the RPH pin is held to COM internally, the resistor $R_{PH}$ is connected in parallel with the $R_T$ resistor, thereby increasing the current in the RT (and CT) pin. The preheat frequency is determined by the following formula: $$f_{PH} = \frac{1}{2\left(\frac{R_T \cdot R_{PH}}{R_T + R_{PH}} \cdot C_T + td\right)}, \text{ or}$$ $$R_{PH} = \frac{\frac{1}{C_T}\left(\frac{1}{2f_{PH}} - td\right)}{1 - \frac{1}{R_T \cdot C_T}\left(\frac{1}{2f_{PH}} - td\right)}$$ The current into the RT pin during the preheat mode should be kept in the range of 50 $\mu$A to 500 $\mu$A in order to maintain good linearity between the RT pin current an the $C_T$ charging current. At the end of the preheat time, the internal open-drain NMOS pulldown transistor at the RPH pin turns off, allowing the RPH pin to exponentially decay from its preheat value to its ignition value. The time constant of the ignition ramp is controlled by the ignition capacitor ($C_{IGN}$) and the preheat resistor ($R_{PH}$). If no capacitor is connected from the RPH pin to COM, the output frequency will quickly change from its preheat value to its ignition value at the end of the preheat time. When the IC is in either an under voltage lockout or fault mode (shutdown, over current, under current or over temperature), the RPH pin is internally shorted to COM. |
| RUN | Run Resistor Pin. The RUN pin is internally connected to the drain of an NMOS pulldown transistor. Normally, a resistor ($R_{RUN}$) is connected from the RUN pin to the RT pin. During the run mode, when the RUN pin is held to COM internally, the resistor $R_{RUN}$ is connected in parallel with the $R_T$ resistor, thereby increasing the current in the RT (and CT) pin. The run frequency is determined by the following formula: $$f_{RUN} = \frac{1}{2 \cdot \left(\frac{R_T \cdot R_{RUN}}{R_T + R_{RUN}} \cdot C_T + td\right)}, \text{ or}$$ $$R_{RUN} = \frac{\frac{1}{C_T}\left(\frac{1}{2f_{RUN}} - td\right)}{1 - \frac{1}{R_T \cdot C_T}\left(\frac{1}{2f_{RUN}} - td\right)}$$ The current into the RT pin during the preheat mode should still be kept in the range of 50 $\mu$A to 500 $\mu$A in order to maintain good linearity between the RT pin current and the $C_T$ charging current. When the IC is in either an under voltage lockout or fault mode (shutdown, over current, under current or over temperature), the RUN pin is internally shorted to COM. |
| CPH | Preheat Timing Pin. A capacitor connected between the CPH pin and the COM sets the preheat time. An internal 1.0 $\mu$A current source charges the preheat capacitor. When the IR2157 initially starts to oscillate, the frequency is held constant at the preheat value (preheat mode) unit CPH is charged to the threshold of 4.0V. At this point the frequency changes to the ignition value (ignition mode). When the |

-continued

| Lead | |
|---|---|
| Symbol | Description |
| | CPH charges to a threshold of 5.1V the frequency changes again to the run value (run mode). The preheat time is calculated using the following formulas:<br>$t_{PH} = 4.0E6 \cdot C_{PH}$, or<br>$C_{PH} - 250E\text{-}9 \cdot t_{PH}$<br>The time until the IC reaches the run mode is determined by the following formula:<br>$t_{RUN} = 5.1E6 \cdot C_{PH}$<br>The difference between $t_{RUN}$ and $t_{PH}$ is the duration of the ignition mode. When the IC is in either an under voltage lockout or fault mode (shutdown, over current, or over temperature), the CPH pin is internally shorted to COM. |
| SD | Shutdown Pin. This pin is used to shutdown the oscillator, pull both of the gate driver outputs low, and put the IR2157 in an interim micropower state in an unlatched mode. When the IC is driven into the shutdown mode, the DT, CPH, RPH and RUN pins are internally shorted to COM, and the CT pin is shorted to COM through the deadtime resistor. The rising shutdown pin threshold voltage is 2.0V with approximately 0.17V of hysteresis included to increase noise immunity. The output of the SD comparator resets the fault latch, so that when the SD pin voltage is brought back below its input threshold (signaling a lamp reinsertion) the IC reinitiates the preheat sequence. This auto-restart feature allows the user to swap lamps without cycling the main supply. |
| CS | Current Sense Pin. This pin is also used to shut down the oscillator, pull both of the gate driver outputs low, and put the IR2157 into an interim micropower state by setting a fault latch. When the IC is driven into the fault mode, the DT, CPH, RPH and RUN pins are internally shorted to COM, and the CT pin is shorted to COM through the deadtime resistor. The CS pin shuts down the IC for either over current or under current conditions. For the over current condition, there is a positive going 1.0V threshold on the CS pin which is enabled at the end of the preheat mode. If the voltage at the CS pin goes above this 1.0V threshold, the IC is put into fault mode. For the under current condition, there is a negative going threshold of 0.2V which is enabled at the onset of the run mode. The sensing of this condition is synchronized with the falling edge of the LO output. If the voltage at the CS pin is below the 0.2V threshold just prior to the falling edge of the LO output, the IC will go into the fault mode. The fault latch triggered by the CS comparators is reset by the output of the SD comparator so that when the SD pin voltage is brought back below its input threshold (signaling a lamp reinsertion), the IC reinitiates the preheat sequence. The fault latch is also reset by cycling the voltage on the IR2157 below the under voltage lockout threshold. |
| DC | DC Bus Input Pin. This pin is used to sense the voltage on the DC bus, in order to properly start up and shut down the control IC. When power is first supplied to the IC, two conditions are required before oscillation is initiated: 1) the voltage on the VCC pin must exceed the rising under voltage lockout threshold; and 2) the voltage at the DC pin must exceed 5.1V. In line fault condition, or when the power to the ballast has been shut off, the DC bus will collapse prior to the VCC of the chip (assuming the VCC is derived from a charge pump off of the output of the half-bridge). In this ease, the voltage of the DC pin will shut the oscillator off, thereby protecting the power transistor from potentially overheating due to hard switching. |
| LO | Low-Side Gate Driver Output. This pin connects to the gate of the low-side power MOSFET or IGBT. If high dv/dt conditions present at the output of the half-bridge cause the power transistor Miller currents (i.e., gate-to-drain currents) to exceed 0.5A, it is recommended that gate resistors be used to buffer the IC from the power stage. When the IC first starts up, or recovers from a fault condition, the LO output is turned on first, in order to recharge the bootstrap capacitor. |
| VB | High Side Gate Driver Floating Supply. This is the power supply pin for the high-side level-shifting and gate driver logic circuitry. Power is normally supplied to the high-side circuitry by means of a simple charge pump from VCC. A high voltage, fast recovery diode (the so-called bootstrap diode) is connected between VCC (anode) and VB (cathode), and a capacitor (the so-called bootstrap capacitor) is connected between the VB and VS pins. When the low side power MOSFET or IGBT is on, the bootstrap capacitor is charged from the VCC-to-COM decoupling capacitor by means of the bootstrap diode. When the high-side power MOSFET or JGBT is turned on, the bootstrap diode is reverse-biased, and the VB node floats above the source potential of the high-side power MOSFET or IGBT. VB should be bypassed to VS as close as possible to the IC pins with the low ESR/ESL capacitor. The value of this capacitor should be kept to a minimum value at least 50 times the value of the total input capacitance ($C_{ISS}$) of the power transistor being driven. |
| VS | High Voltage Floating Supply Return. The high-side gate driver and logic circuitry returns to this pin. The VS pin should be connected directly to the source of the high-side power MOSFET or IGBT. In addition, the half-bridge output transistors should be placed as close together as possible, in order to minimize series inductance between them. |
| HO | High-Side Gate Driver Output. This pin connects to the gate of the high-side power MOSFET or IGBT. If high dv/dt conditions present at the output of the half-bridge cause the power transistor Miller currents (.e., gate-to-drain currents) to exceed 0.5A, it is recommended that gate resistors be used to buffer the IC from the power stage. |

The five basic modes of operation of the IC will now be described:

Mode 1: Under Voltage lockout (UVLO):

In this mode of operation, only important housekeeping functions are active within the IC 2. The fluorescent current of the chip (IQCCUV) is kept to as low a value as is practical (for the IC of the present invention, a typical value is 150 $\mu$A), in order to facilitate starting up the IC using a ¼ watt resistor from the rectified line or DC bus (See FIG. 2, resistor 10). The oscillator is disabled, and as a result RT=CT=DT=RUN=0V. The preheat pin (CPH) is actively held to 0V, and the VDC pin is biased to a voltage equal to a fraction of the DC bus (or rectified AC line) voltage. In the UVLO mode, the comparator sensing the voltage on the VDC pin is biased, in order to control the proper start-up sequence. The gate driver outputs are held low (LO and HO-VS) in order to prevent unwanted switching at the output of the half-bridge (MOSFETs 6, 8). The VCC voltage typically lies between 0V and the rising under voltage lockout threshold (in this case, 11.4V), although the IC can be put into the UVLO mode with VCC greater than this rising threshold under certain fault conditions (described later). The CS pin is at 0V, assuming no switching at the output of the half-bridge. The floating supply (VB-to-VS) formed by capacitor 12 and diode 14 from VCC may be 0V, or VCC—0.7V (the forward voltage drop of diode 14), or a voltage between 0V and 20V (the recommended maximum voltage for VB-to-VS), depending on the configuration of the circuitry external to the IC.

The SD pin is typically biased below its 2.0V rising threshold at start-up, although the SD pin is one of the three pins which control the UVLO mode (the other pins are VCC and VDC). As with the VDC and VCC pins, a biased comparator senses the voltage at the SD pin in order to help control the UVLO mode.

2. Preheat Mode:

In this mode of operation, much of the internal circuitry within the IC has been biased and enabled. As a result, the oscillator is running. The RT pin, which functions as a voltage-controlled current input, is biased at approximately 2.0V. The RPH pin is held at 0V, effectively connecting resistor $R_T$ and resistor 16 in parallel during the preheat mode. The current resulting from the voltage of 2.0V across the parallel combination of resistor $R_T$ and resistor 16 is mirrored within the IC, and is used to program the current which charges the CT capacitor ($C_T$). The lower and upper thresholds sensed on the CT pin for oscillation are 2.0V and 4.0V, respectively. The fall time on the CT waveform, which represents the deadtime between the alternate switching of the LO and HO-VS outputs, is programmed by means of capacitor $C_T$ and the deadtime resistor 18 in FIG. 2.

Figure 4:
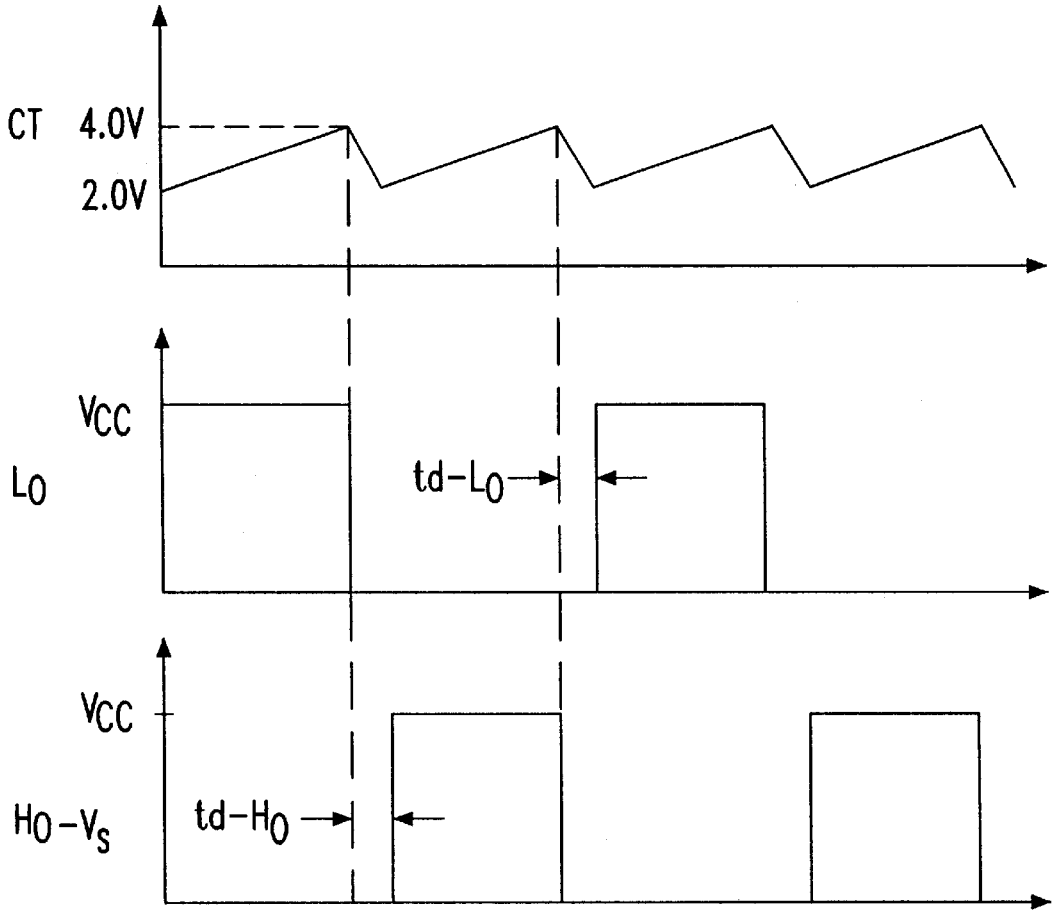
FIG. 4 is a timing diagram which illustrates the basic relationship between the CT waveform and the output voltages of the IC, namely LO and HO-VS.

FIG. 4 illustrates the basic relationship between the CT waveform and the output voltages. The toggle flip flop 20, along with the divide-by-two logic circuitry (FIG. 3), splits the oscillator output into the LO and HO-VS output drive signals. Thus, the output of the half-bridge (transistors 6, 8) switches at half of the oscillator frequency.

During the preheat mode, an external capacitor 24 on the CPH pin is charged by an internal, 1 $\mu$A current source, and the preheat time (i.e., the duration of oscillation at the preheat frequency) is determined by how long it takes to charge this capacitor from 0V to 4V, according to the following equation:

$$t_{PH} = \frac{C_{24}(4.0V)}{1\mu A}$$

The 1 $\mu$A current source value was chosen in order to allow users of the IC to make the preheat capacitor 24 (FIG. 2) a surface mount type (i.e., less than approx. 470 nF for typical preheat times for rapid start fluorescent lamps).

Input conditions required for preheat operation include:

1) VCC>rising UVLO threshold (11.4V in the preferred embodiment)
2) VDC>5.1V (signaling that the DC bus or rectified AC line is ok.

The reason that 1.0V CS threshold is not enabled during preheat is that hard switching always occurs when the half-bridge first starts oscillating, and this hard switching would be interpreted as a fault condition and would shut the ½-bridge off.

The reason for not enabling the no-load 0.2V CS threshold is that during the initial cycles of preheat, as well as during the transition from ignition to the run mode, it is possible for the current in the lower MOSFET 8 (FIG. 2) to naturally go to zero for at least one cycle (the latter behavior, between ignition and running, is only observed for certain lamp types, such as 40W, T12 type).

For the same reason, the below-resonance 0.2V CS threshold is not enabled during preheat.

Finally, even in the event of a condition where there is no load on the output of the ½-bridge, but SD is less than 1.7V (signaling that the lamp 4 is not faulty), the hard switching observed by the power MOSFETs (6 and 8) would not result in substantial device heating (the preheat time for a rapid start fluorescent lamp is typically 0.5–2.0 sec). In addition, the thermal time constant for a typical power transistor package (e.g., TO-220) is 0.5–1.0 min.

In summary, during the preheat mode,

VCC>11.4V (under normal operating conditions),

VDC>5.1V

SD<1.7V $T_j$<175° C.

0V<VCPH<4.0V

VRT=2.0V

RPH=0V

RUN=open ckt

As described more fully below in the section entitled "Flash Free Start-Up," the preferred embodiment of the present invention includes a series connection of a resistor and capacitor from the RT pin to ground to provide a "pre-preheat" frequency ramp. This initial frequency ramp advantageously prevents a brief over voltage on the lamp at start-up, as shown in FIG. 7.

Waveform A of FIG. 7 illustrates what can happen during the initial cycles in preheat. The voltage across the lamp can briefly exceed the strike potential of the lamp, resulting in the establishment of an arc current within the lamp. Although this arc of current may not be visible due to its brief duration, the current flow itself occurs when the lamp filaments are cold, thereby degrading the lifetime of the emissive coating on the filament. The net result is that the ballast itself shortens the life of the lamp, rather than prolonging it. By starting at an even higher frequency, even just for a few cycles, the waveform B in FIG. 7 results, thereby protecting the integrity of the emissive coating on the lamp filaments.

3. Ignition Ramp Mode:

When the voltage at the CPH pin has reached 4.0V, the IC 2 enters the ignition ramp mode of operation. At this point, the open drain NMOS transistor 26 (FIG. 3) connected between the RPH pin and COM (the IC ground) turns off. In a typical connection arrangement (see FIG. 2), an ignition ramp capacitor 28 is connected from the RPH pin to ground (COM). Thus, when the internal open drain NMOS transistor 26 on the RPH pin turns off, capacitor 28 charges up exponentially to the RT pin voltage, according to the following equation:

$$V_{RPH} = V_{RT}\left(1 - \exp\left(-\frac{t}{R_{16} \cdot C_{28}}\right)\right)$$

This exponential rise in the voltage on the RPH pin results in an exponential decay in the current in the RT pin attributed to resistor 16 (FIG. 2), resulting in a decrease in the operating frequency at the output of the half-bridge.

Figure 5:
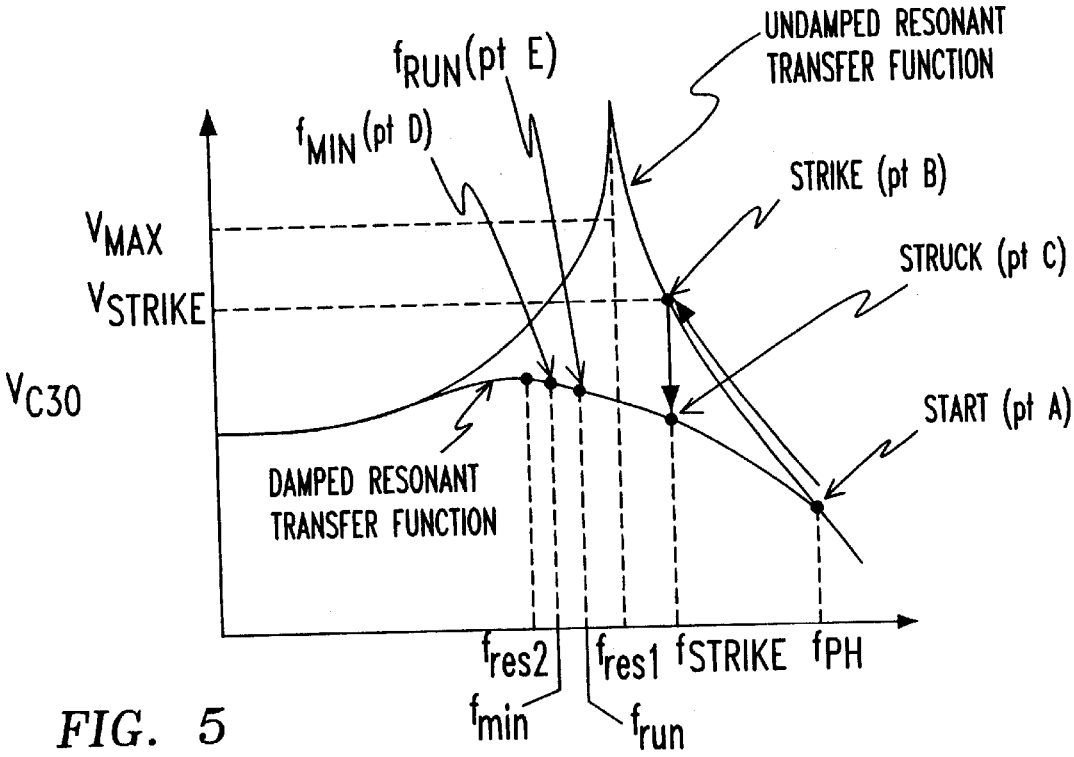
FIG. 5 shows the transfer functions involved in the operation of the integrated circuit of the present invention.

The effect of this decay in operating frequency is to allow the voltage across the resonant capacitor 30 to increase enough to strike the lamp 4. This is shown in FIG. 5, as follows:

At the end of preheat, the frequency decays from point A, and as a result of the natural, undamped resonant curve for the voltage across 30, if $f_{MIN}$ is chosen properly, the lamp will strike at point B. Once the lamp has struck, a new load transfer function exists, which has significantly lower gain than the undamped response. As a result, once the lamp has struck, the load operation point changes from point B to point C in FIG. 5. The voltage across resistor 16 in FIG. 2 continues to exponentially decay to zero, though, and as a result, the output frequency continues to decay toward $f_{MIN}$ (point D in FIG. 5).

Figure 6:
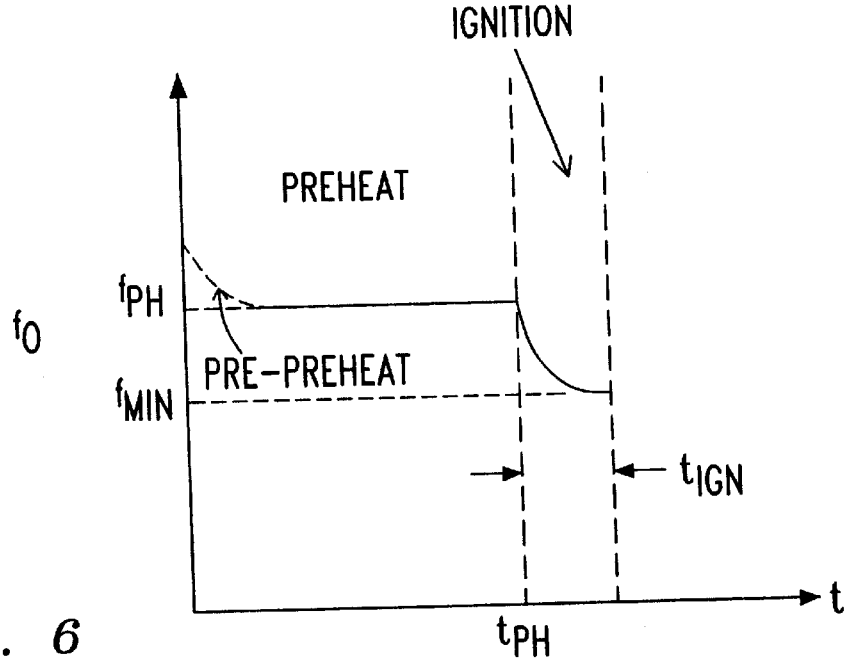
FIG. 6 shows a plot of the frequency of operation of the IC of the present invention during the preheat and ignition modes.

The end of the ignition ramp mode is signaled when the voltage on the CPH pin has charged up to 5.1V from 4V. Typically, then, the external components (capacitor 24, capacitor 28, $C_T$, $R_T$, resistor 16, and resistor 18) are chosen so that the output frequency has ramped to $f_{MIN}$ prior to where the voltage on the CPH pin ramps from 4V to 5.1V. This is shown in FIG. 6.

At the beginning of the ignition mode, when the voltage on the CPH pin reaches 4.0V, the 1.0V CS threshold is enabled. The purpose for enabling this threshold at the end of preheat is to make certain that in the event of a faulty lamp (e.g., filaments OK but no gas in the lamp) that the voltage across the resonant capacitor (i.e., capacitor 30 in FIG. 2) does not exceed the capacitor's maximum rating (note that the resonant curve shown in FIG. 5 could depict the load current, and thereby the current sensed by the CS pin, on the y axis just as easily as $V_{cap30}$ as both illustrate resonance).

In summary, during the ignition ramp mode,

1) CPH is charging from 4V to 5.1V by means of a 1 $\mu$A current source through an external capacitor;
2) RPH is open circuit;
3) RUN is open circuit; and
4) The 1.0V CS threshold is enabled.

4. Run Mode:

The run mode begins when the CPH pin has charged up to 5.1V. At this point, the RUN pin is shorted to ground internally through an open drain NMOS transistor 32. As a result, resistor 34 in FIG. 2 is connected in parallel with resistor $R_T$, thereby increasing the operating frequency. This transition is illustrated in FIG. 5 (from points D ($f_{MIN}$) to E ($f_{RUN}$)).

The change from $f_{MIN}$ to $f_{RUN}$ is of critical importance to the ease of high volume lamp ballast manufacturing. Although for certain lamp types and corresponding load circuit arrangements, it is possible to accommodate a control sequence which requires that $f_{PH}>f_{IGN}>F_{RUN}$ in high volume manufacturing, it is possible that $f_{MIN}$ and $f_{RUN}$ are so close together that problems striking the lamp can occur. It is better to provide the user with independent control over the control sequence, such that $f_{PH}>f_{IGN}>f_{MIN}$, but that the only other constraint is $F_{RUN}>f_{MIN}$. This allows the user to overdrive the lamp slightly during the ignition ramp mode, in order to guarantee proper lamp striking over all environmental and manufacturing tolerance conditions. This independent control of $f_{PH}$, $f_{MIN}$, $F_{RUN}$, and the ignition ramp using external resistors facilitates the production trimming of these modes of operation by the ballast or lamp manufacturer. The reduction in the tolerance of these parameters will allow the user to obtain maximum lamp life and ballast reliability.

Another event which occurs upon entering the run mode is that the 0.2V CS threshold is enabled (both for no-load and for operation below resonance). Thus, as mentioned before, the occurrence of no load current for at least one cycle of the half-bridge should be past, and therefore, it is safe to check for real fault conditions. The same applies for operation below resonance. It is assumed (and observed, based on analysis of many different lamp types) that by the time CPH reaches 5.1V, the load current and voltage (under normal operating conditions) have reached a steady state.

5. Fault Mode:

In the fault mode of operation, one of four conditions has been sensed:

1) CS>1.0V (over current or hard switching);
2) CS<0.2V (no load);
3) CS<0.2V (operation below resonance); or
4) $T_j$>175° C. (over temperature condition).

After sensing one of these conditions, a fault latch 36 is set (FIG. 3). Once this fault latch is set, several actions are taken within the IC:

1) The gate driver outputs LO and HO-VS are driven low, turning off the output of the ½-bridge. 2) The T (toggle) flip-flop 20 which splits the oscillator output into the high-side and low-side gate driver control signals is reset so that once oscillation is reinitiated, the LO output always comes on first.
3) The CPH pin is shorted to ground through an internal open drain NMOS transistor 38, resetting the preheat sequence.
4) The oscillator is turned off, as is the primary voltage reference, and as a result RPH=RT=RUN=CT=DT=0V.
5) The bias to much of the internal circuitry is turned off, resulting in a quiescent current of approximately 150AA.

A consequence of holding the output off and having low quiescent current is that the VCC voltage will remain at 15.6V (or will charge to 15.6V if it wasn't there already). In the absence of any additional external input, the chip could stay in this mode indefinitely. From a lamp maintenance point of view, however, once it is recognized that the power to the lamp is on and the lamp itself is off, the lamp will most likely be exchanged for a new tube inserted into the fixture.

The fault latch 36, having been set by one of the four previously mentioned fault conditions, can be reset by one of two signals (see FIG. 3):

1) VCC falling below the lower under voltage lockout threshold (in this case, 9.5V), thereby producing a "high" output from under voltage detect circuitry 40; or
2) SD>2.0V (signalling a lamp exchange).

Description of the State Diagram:

Having described the five different modes of operation for the state diagram, the state diagram itself will now be described.

When power to the ballast is first turned on, the DC bus or rectified AC line voltage will come up, at a dv/dt dependent on the circuit used (PFC control, simple rectifier, etc.) to derive the high voltage input to the ½-bridge. The voltage drop across the start-up resistor 10 (FIG. 2) will cause a current to flow into the VCC decoupling capacitor 42, equal to $$I_{cap42}=(V_{BUS}/R_{10})-I_{QCCUV}$$

As the VCC pin of the IC charges up, the IC is initially in the under voltage lockout (UVLO) mode. When the following four conditions are met, the IC goes from the UVLO mode to the preheat mode.

1) VCC>11.4V (VCC>UV+), and
2) VDC>5.1V (DC bus or AC line), and
3) SD<1.7V (lamp ok), and
4) $T_j$<175° C. (junction temp ok).

If any of these four conditions is not met, then the IC will not go into the preheat mode.

Assuming these four conditions are met, the chip will begin preheating the lamp filaments. The CPH pin will charge towards its 4.0V threshold, and the oscillator will drive the ½-bridge at $f_{PH}$.

While in the preheat mode, several different fault conditions could occur. These faults are divided into two different groups, dependent upon the actions taken as a result of the particular fault. The first group is characterized by putting the IC back into the UVLO mode. This group of faults includes:

1) VCC<9.5V (VCC fault or power down), or
2) VDC<3.0V (DC bus or AC line fault or powerdown), or
3) SD>2.0V (lamp fault or lamp exchange).

Thus, if any one of these faults occurs, the IC is driven back into the UVLO mode (see FIG. 1).

The only other fault which would be sensed in the preheat mode would be a junction over temperature condition ($T_j$>175° C.). If an over temperature condition is sensed on the IC, the fault latch 36 is set, and the chip is driven into the fault mode (see state diagram in FIG. 1).

Assuming a successful preheating of the lamp, when CPH reaches 4.0V, the chip enters the ignition ramp mode. During the ignition ramp, the output frequency exponentially decays from $f_{PH}$ to $f_{MIN}$. The duration of the ignition ramp mode is determined by the CPH capacitor (capacitor 24, FIG. 2), the 1 $\mu$A internal current source, and the ~1V of travel for the CPH pin (4V to 5.1V). The 1V CS voltage threshold is enabled at the beginning of the ignition ramp mode.

Once in the ignition ramp mode, two different kinds of fault conditions can be sensed. The first group drives the IC back into the UVLO mode. These faults are:

1) VCC<9.5V (VCC fault or power down), or
2) VDC<3.0V (DC bus or AC line fault or powerdown), or
3) SD>2.0V (lamp fault or lamp exchange).

The other group of faults drives the chip into the fault mode. These faults are:

1) CS>1.0V (failure to strike the lamp or detection of hard switching), or
2) $T_j$>175° C. (over temperature condition).

If the chip successfully completes the ignition ramp, and CPH reaches its 5.1V threshold, the IC enters the run mode. In this case, the output frequency is switched (when RUN→0V) from $f_{MIN}$ to $f_{RUN}$. The CPH continues to charge (1 $\mu$A), and is eventually clamped by an internal 7.6V zener diode. The final frequency $f_{RUN}$ determines the power delivered to the lamp, and hence, the lamp brightness.

Once the lamp is running (run mode), the 0.2V CS voltage threshold is enabled, so that the chip can sense for a no load condition or for operation below resonance.

Within the run mode of operation, two different kinds of fault conditions can be sensed. The first group drives the IC back into the UVLO mode. These faults include:

1) VCC<9.5V (VCC fault or powerdown), or
2) VDC<3.0V (DC bus/AC line fault or powerdown), or
3) SD>2.0V (lamp fault or lamp exchange).

The second group of faults, which drive the IC into the fault mode, includes:

1) CS>1.0V (over current or hard switching), or
2) CS<0.2V (no load or operation below resonance), or
3) $T_j$>175° C. (over temperature).

From the fault mode, the only way to reset the fault latch is to:

1) bring SD>2.0V (lamp removal), or
2) VCC<9.5V (power to IC cycled to zero).

The following are several examples of powerup, starting, running, and fault detection and correction conditions performed by the IC of the present invention in accordance with the state diagram of FIG. 1.

---

I. Normal Operation
1. Power to ballast turned on
↓
2. Rectified AC comes up, DC bus estabiished
↓
3. UVLO mode
↓
4. Preheat mode
↓
5. Ignition mode
↓
6. Run mode
↓
7. DC bus or rectified AC line drops (VDC < 3V), due to power being turned off
↓
8. UVLO mode
↓
9. IC off, VCC = OV II. Normal Operation - Monkey Test
1. Power to ballast turned on
↓
2. Rectified AC comes up, DC bus established
↓
3. UVLO mode
↓
4. Preheat mode
↓
5. Power to ballast turned off, then back on, causing brief drop in VDC below 3.0V, then back above 5.0V (monkey test on light switch)
↓
6. UVLO mode
↓
7. Preheat mode
↓
8. Ignition mode
↓
9. Run mode
↓
10. DC bus or rectified AC line drops, due to power being turned off
↓
11. UVLO mode
↓
12. IC off, VCC = 0V III. Lamp Fault - Blown Lower Filament
1. Power to ballast turned on
↓
2. Rectified AC comes up, DC bus established
↓
3. UVLO mode
↓
4. Preheat mode
↓
5. Ignition mode
↓
6. Run mode
↓
7. Lower filament fails open circuit (SD > 2V)
↓
8. UVLO mode, VCC = 15.6V, SD > 2.0V
↓
9. Power on, lamp off → lamp exchange, ∴ lamp removed from fixture
↓
10. Still in UVLO mode (same as 8)
↓
11. New lamp inserted, SD < 1.7V
↓
12. Preheat mode -continued ↓
13. Ignition mode
↓
etc.

IV. Lamp Fault - Blown Upper Filament
a) Blown filament disconnects resonant capacitor, arc current continues to flow.
1. Power to ballast turned on
↓
○
○
○
↓
6. Run mode
↓
7. Upper filament fails
↓
8. Lamp remains lit
↓
a) . . .
↓
8. . . .
↓
9. Power to ballast turned off
↓
10. DC bus drops, rectified AC line drops, VDC < 3.0V
↓
11. UVLO mode
↓
12. IC off, VCC = 0V
↓
13. Power turned back on (e.g., next day)
↓
14. Rectified AC comes up, DC bus established
↓
15. UVLO mode
↓
16. Preheat mode
↓
17. Ignition mode, hard switching detected
↓
18. Fault mode, lamp remains off
↓
19. Power on, lamp off → lamp exchange, ∴ lamp removed (SD > 2V), UVLO mode
↓
20. New lamp inserted in fixture, SD < 1.7V (power left on)
↓
21. Preheat mode
↓
a) . . .
↓
21. . . .
↓
22. Ignition mode
↓
23. Run mode
↓
etc.

b) Blown filament disconnects inductor, arc current interrupted.
1. Power turned on
↓
○
○
○
↓
6. Run mode
↓
7. Upper filament fails
↓
8. Either hard switching detected (CS > 1.0V) or no load detected (CS < 0.2V)
↓
9. Fault mode
↓
10. Power on, lamp off → lamp exchange, lamp removed from fixture, (SD > 2V), UVLO mode
↓
11. New lamp inserted into fixture, SC < 1.7V (power left on)

V. Lamp Fault - Blown Filament
1. Power turned on.
↓
○
○
○
↓
11. . . .
↓
12. Preheat mode
↓
13. Ignition mode
↓
14. Run mode
↓
etc.

VI. Lamp Fault - Asymmetrical Lamp Voltage (Rectification)
1. Power turned on
↓
•
•
•
↓
6. Run mode
↓
7. Lamp voltage becomes asymmetrical indicating end of life of lamp, hard switching detected (CS > 1.0V)
↓
8. Fault mode
↓
9. Power on, lamp off → lamp exchange, ∴ lamp removed, SD > 2V
↓
10. New lamp inserted into fixture, SD < 1.7V, UVLO mode
↓
11. Preheat mode
↓
etc.

VII. Lamp Fault - Glass Cracks While Lamp is Running, Gas Escapes, Filaments OK
1. Power turned on
↓
•
•
•
↓
6. Run mode
↓
7. Glass cracks while lamp is running, gas escapes, arc current collapses, load transfer function goes from damped back to undamped (filaments ok), operation below resonance (CS < 0.2V)
↓
8. Fault mode
↓
9. Power on, lamp off → lamp exchange ∴ lamp removed, SD > 2V, UVLO mode
↓
10. New lamp inserted into fixture, SD < 1.7V, (power left on)
↓
11. Preheat mode
↓
etc.

VIII. Lamp Fault - Start-up for Lamp With No Gas, Filaments OK
1. Power turned on
↓
2. Rectified AC comes up, DC bus established
↓
3. UVLO mode
↓
4. Preheat mode -continued ↓
5. Ignition mode, CS > 1.0V (failure to strike)
↓
6. Fault mode
↓
7. Power on, lamp off → lamp exchange
∴ lamp removed, SD > 2V, UVLO mode
↓
etc.

IX. Loss af AC Line While Running
1. Power turned on
↓
•
•
•
↓
6. Run mode
↓
7. Loss of line; VCC > 9.9V (UV−), VDC < 3.0V
↓
8. ½-bridge shut off, lamp turns off, UVLO mode
↓
9. Line recovers, VDC > 5V
↓
10. Preheat
↓
11. Ignition
↓
12. Run
↓
etc.

X. Over temperature Condition While Running (Self Heating)
1. Power turned on
↓
•
•
•
↓
6. Run mode
↓
7. $T_j$ > 170° C., fault mode, lamp off
↓
8. Power on, lamp off → lamp exchange
∴ lamp resolved, SD > 2V, UVLO mode
↓
etc.

XI. Over temperature Condition while Running - Heating Due to Ambient Temp Rise Around Ballast (e.g., Conditioner Failure)
1. Power turned on
↓
•
•
•
↓
6. Run mode
↓
7. $T_j$ > 170° C., fault mode, lamp off
↓
8. Power on, lamp off → lamp exchange
∴ lamp removed, SD > 2V, $T_j$ > 170° C., so still fault mode
↓
9. New lamp inserted into fixture, SD < 1.7V, $T_j$ still > 170° C.
↓
10. Still in fault mode
↓
11. Power on, lamp still off despite lamp exchange, ∴ ballast suspected to have failed
↓
12. Next action depends on many factors:
a) Is $T_j$ > 170° C. permanent? If yes, then ballast exchange doesn't fix problem (most likely, maintenance person would be unable to change ballast in this hot environment).
b) If $T_j$ > 170° C. is not permanent, then more possibilities.
i) power cycled prior to ballast exchange (after $T_j$ < 170° C.) → lamps turn on, no exchange needed
ii) power not cycled prior to ballast exchange → ballast exchanged, lamps turn on The following sections describe in greater detail specific advantageous features of the present invention which are included in the state diagram operation discussed above.

1. Control Circuitry For Ensuring Equal Width Drive Pulses Upon Start-Up

FIG. 8 illustrates the portion of the block diagram of a prior art ballast driver integrated circuit (namely the I2155) which performs the oscillator function for deriving the alternating, non-overlapping, 50% duty cycle gate drive signals HO and LO for driving MOSFETs (or IGBTs) of the half-bridge circuit.

In FIG. 8, comparator 50 and comparator 52 along with the RS latch 54 and the divider comprised of resistors 56, 58, and 60, form the 555-type oscillator incorporated in the IR2155 IC. By connecting an external resistor $R_T$ and capacitor $C_T$, the steady state frequency of oscillation at the RT pin can be programmed according to the following formula:

$$f_{RT} = \frac{1}{1.4 R_T C_T}$$

Figure 9:
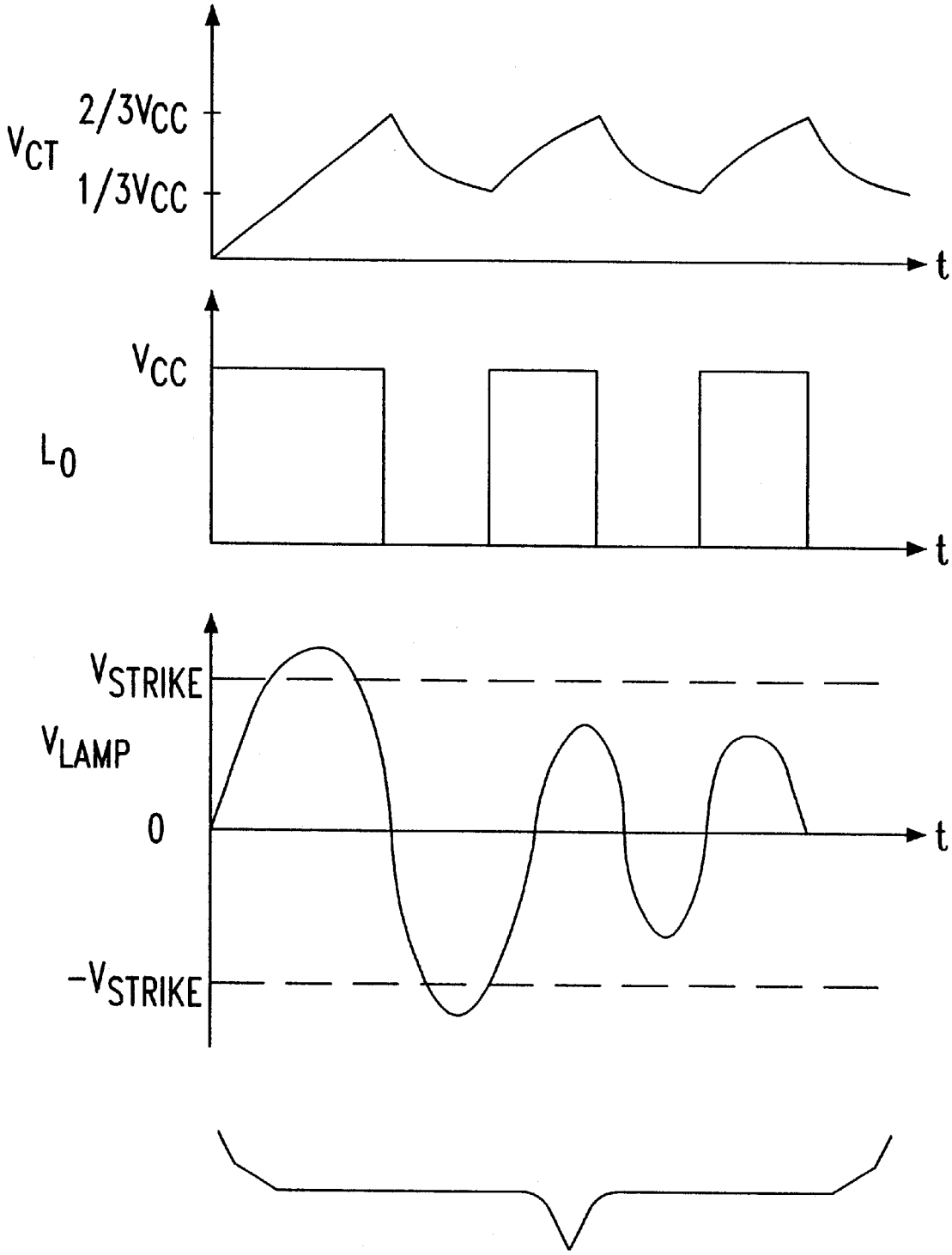
FIG. 9 illustrates the input and output waveforms for the prior art IR2155 IC during the initial turn-on sequence, showing that the initial output pulse is longer than subsequent pulses.

FIG. 9 illustrates the input and output waveforms for the IC during the initial turn-on sequence. These waveforms illustrate the problem which needed to be corrected.

At the time when the VCC voltage of the IC reaches the rising threshold of the internal under voltage lockout circuit, the NMOS transistor which had been holding the CT pin low, turns off. Because the RT pin voltage is high at this instant, the $C_T$ capacitor begins to charge up by means of the $R_T$ resistor. The time it takes the CT pin to charge from its initial condition ($V_{CT}$=0V) to the ⅔ VCC threshold is $$t_1 = 1.11\ R_T C_T$$

This time is therefore the width of the first pulse seen on the LO output.

On the other hand, the time it takes for the CT pin to charge down from ⅔ VCC threshold to the ⅓ VCC level (i.e., from $t_1$ to $t_2$) yields the result:

$$t_2 - t_1 = 0.69\ R_T C_T$$

As is well known about this particular form of oscillator, assuming a stable value of VCC, all subsequent charge and discharge times (e.g., $t_3-t_2$, $t_4-t_3$, etc.) are equal to 0.69 $R_T C_T$.

The relationship between the above equations illustrates the problem to be solved, namely, that the first pulse is longer than subsequent pulses, as shown in FIG. 9. The effect of this longer first pulse is that the load is driven initially at a lower frequency, resulting in excess voltage across the lamp. This is shown in the bottom trace of FIG. 9.

The longer, first pulse shown on $V_{CT}$ in FIG. 9 results in a higher voltage across the lamp, and if the voltage exceeds the strike potential of the lamp, a brief flash can be seen on the lamp, and the lamp filament lifetime is greatly reduced.

The concept of the invention is simply to use circuitry within the control integrated circuit of the present invention to ensure that all of the LO and HO output pulses are the same width once the IC starts up.

Figure 10:
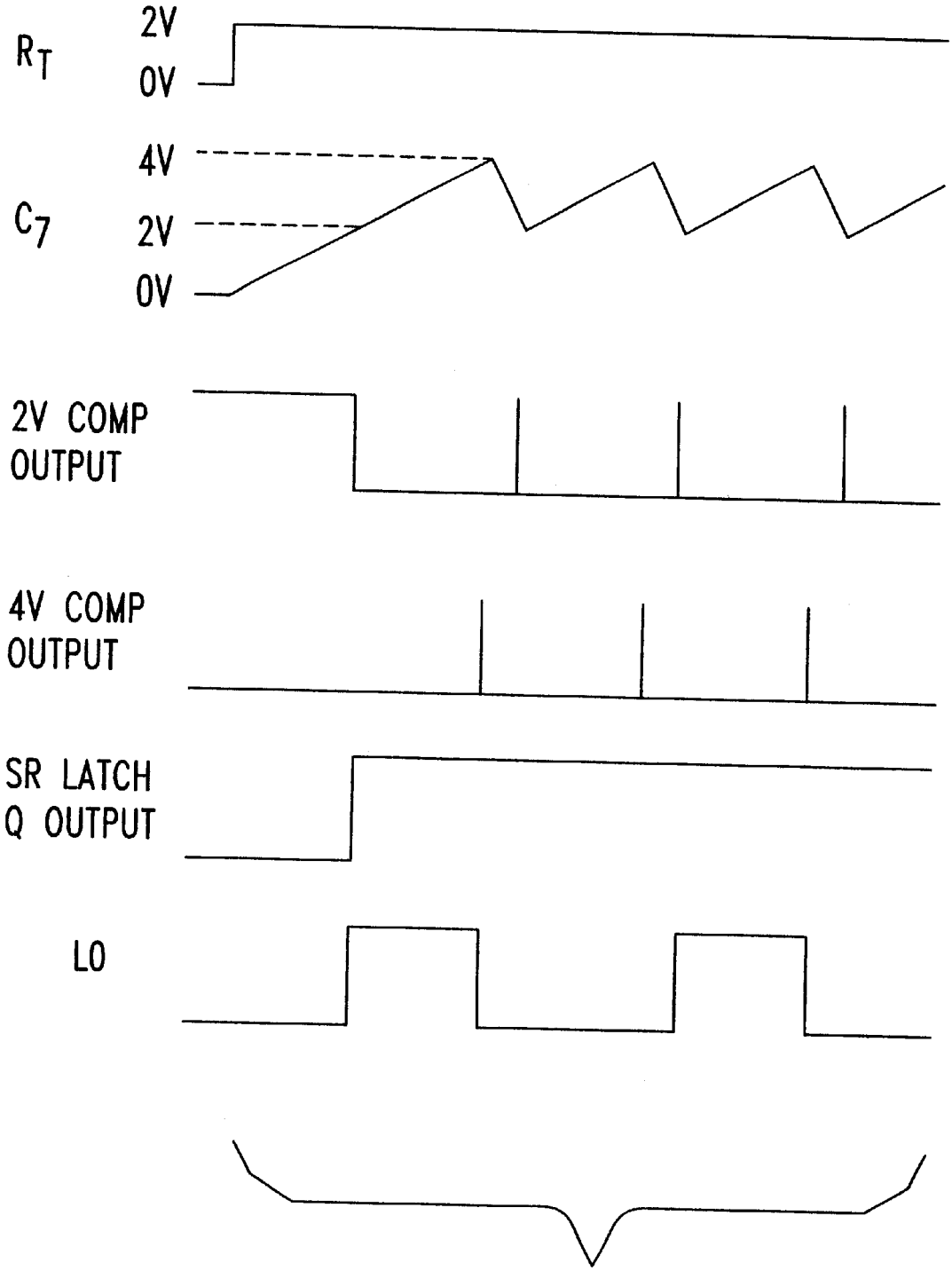
FIG. 10 is a timing diagram of the input and output waveforms for the IC of the present invention which includes control circuitry for ensuring equal width drive pulses upon start-up, showing that all of the LO and HO output pulses are the same width once the IC starts up.

The result of this improved start-up procedure is that now the lamp voltage does not exceed the strike potential, no flash is seen, and a significantly higher reliability is achieved. This new start-up characteristic is shown in the timing diagram of FIG. 10.

Dashed portion 70 in the block diagram of the present invention (FIG. 3) shows the circuitry for implementing this feature of the invention. Comparator 72 senses the voltage on the CT pin and compares it to a 2.0V reference which is the lower threshold of the oscillator. The output of comparator 72 is high at any time that the voltage on the CT pin is less than the 2.0V reference. The output of comparator 72 is fed to the input of inverter 74 whose output is then fed to the set input of RS latch 76. During UVLO mode or fault mode, RS latch 76 is reset and the Q output is low. When the Preheat mode is entered, the reset input of RS latch 76 is pulled low and the output Q remains low. At the same moment of entering Preheat mode, the CT pin voltage begins to rise from its initial condition of 0V. When the voltage on the CT pin rises above 2.0V, the output of comparator 72 goes low which in turn sets RS latch 76 and its Q output goes high and remains high until entering either UVLO mode or Fault mode. The Q output of RS latch 76 is fed to one of the inputs of each of AND gate 77 and AND gate 78. This effectively blocks any switching of the LO output prior to CT pin rising above the 2.0V threshold for the first cycle of the oscillator and hence the duration of the first pulse of the LO output is the same as all subsequent pulses. At this point the voltage on the CT pin oscillates between the 2.0V and the 4.0V thresholds of the oscillator.

2. Flash Free Start-Up

If the frequency of operation is too low at the initiation of the pre-heat mode, the resultant high voltage across the lamp can cause the lamp to momentarily strike, causing an undesirable momentary flash which is not pleasing to the eye and can degrade the life expectancy of the lamp.

Figure 11:
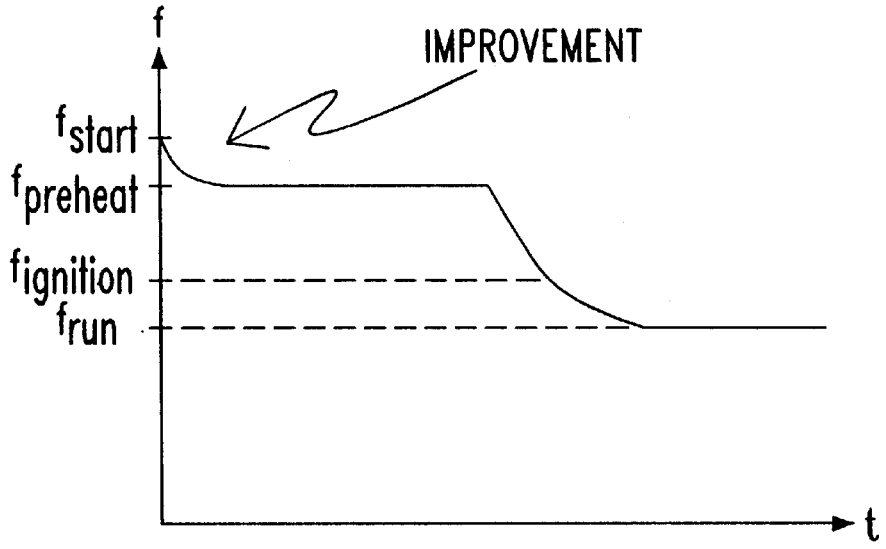
FIG. 11 is a plot of the frequency of operation versus time in the "flash-free start-up" sequence of the pr sent invention.
Figure 12:
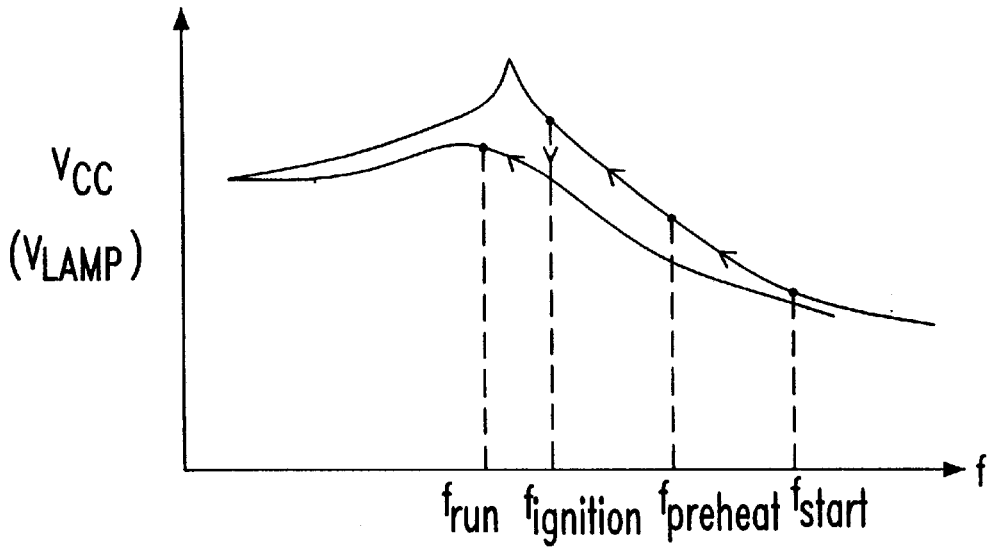
FIG. 12 shows the transfer function of the "flash free start-up" sequence of the present invention.

An improved start-up sequence is included in the IC of the present invention to insure that the lamp will not flash upon initial application of power to the ballast. This flash free start-up sequence is depicted in FIGS. 11 and 12. FIG. 11 depicts the frequency of oscillation versus time. As can be seen, the sequence begins with a frequency $f_{START}$ which is higher than the frequency $f_{PREHEAT}$ at time zero; i.e., the improved sequence starts at a frequency of oscillation higher than that of preheat. The frequency is then ramped to the value needed to preheat the lamp cathodes. Observing FIG. 12, it is seen that by operating at a frequency higher than that needed for preheat the point of operation is further away from the resonant frequency of the series LC circuit. This being the case, the voltage across the lamp starts at a lower magnitude and consequently further below the level which can cause the lamp to ignite.

Figure 13:
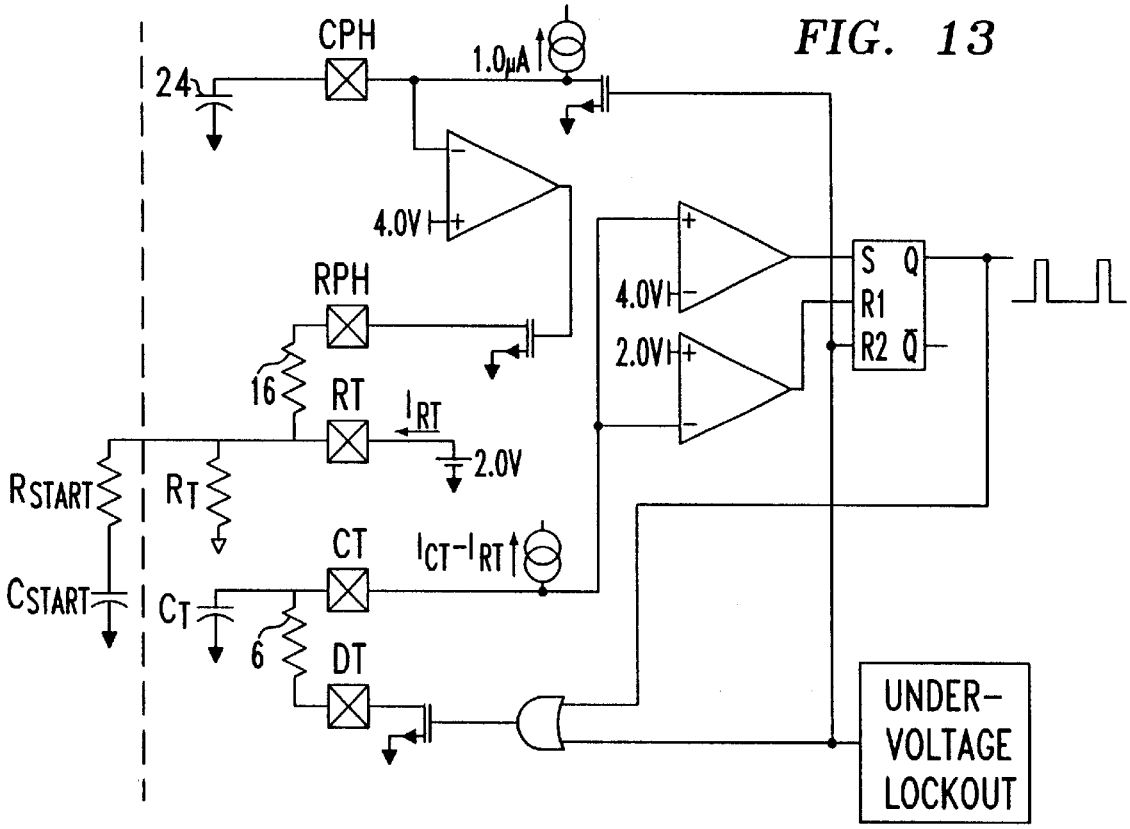
FIG. 13 is a block diagram of the oscillator section of the ballast driver IC of the present invention.

A simple means of implementing this improved start-up sequence is facilitated by the oscillator section in the half-bridge MOS gate driver integrated circuit of the present invention. The ballast driver IC 2 of the present invention contains an oscillator similar to that of industry standard pulse width modulator integrated circuits. The frequency of oscillation is programmed by the choice of resistor $R_T$ and capacitor $C_T$ shown in FIG. 2. The resistor values are chosen which will program a charging current which is used to ramp the voltage up on the oscillator capacitor $C_T$. A second resistor 18 is used to discharge oscillator capacitor $C_T$. A block diagram of the oscillator section of the ballast driver integrated circuit of the present invention is shown in FIG. 13. With the connection as shown in FIG. 13, but without the inclusion of resistor $R_{START}$ and capacitor $C_{START}$ shown therein, the preheat oscillation frequency is fixed and does not vary as a function of time.

The operation of the oscillator without resistor $R_{START}$ and capacitor $C_{START}$ is as follows:

When power is initially applied to the ballast driver IC of the present invention, the preheat timing capacitor 24, is discharged. The voltage on RT pin is held to zero and no oscillation occurs. When the voltage rises above the under voltage lockout threshold, capacitor 24 begins to charge up and the voltage on RT pin is turned on. At this point, the ballast driver IC begins to oscillate at the preheat frequency. This frequency is determined by the parallel combination of $R_T$ and resistor 16. When the voltage on capacitor 24 reaches a predetermined threshold, signaling the completion of preheat mode, resistor 16 is effectively removed from the circuit. At this point, the oscillation frequency is determined solely by resistor $R_T$ and thus the frequency shifts down to the run value.

To implement the improved start-up sequence, the addition of two components, resistor $R_{START}$ and capacitor $C_{START}$, as shown in FIG. 13, are all that is needed. These components modify the operation as follows:

As in the preceding case, prior to the ballast driver IC coming out of under voltage lockout mode, capacitor 24 is discharged and the voltage on the RT pin is held to zero. This being the case, capacitor $C_{START}$ is also discharged. When the voltage on the ballast driver IC rises above the under voltage lockout threshold, $C_{PH}$ begins charging and the voltage on the RT pin turns on. The ballast driver IC begins to oscillate but in this case the frequency is determined by the parallel combination of resistors 16, $R_T$ and $R_{START}$. The addition to the combination of resistor $R_{START}$ occurs at the initial start of oscillation because capacitor $C_{START}$ was initially discharged. However, the influence of $R_{START}$ on the oscillation frequency diminishes with time as $C_{START}$ charges through $R_{START}$. As the voltage on $C_{START}$ approaches the level of voltage on the RT pin, the current drawn by $R_{START}$ approaches zero and the frequency of oscillation is determined only by the parallel combination of resistor 16 and $R_T$. (This of course assumes that the $C_{START}$ charging time is much shorter than the preheat mode time.) Thereafter, the operation of the oscillator is the same as in the previous description.

3. DC Bus/AC On/Off Control Circuit

In an electronic ballast powering a fluorescent lamp, it is convenient and sometimes necessary to have turn-on and turn-off control at programmable levels of the DC bus voltage or the AC line voltage. In addition to the standard under voltage control performed by the ballast control performed by the ballast control circuitry or IC, which activates and deactivates the ballast at pre-determined levels of the control supply voltage (VCC), DC bus or AC line on/off control ensures that the ballast output stage is supplied by a minimum DC bus voltage level at all times during operation.

If on/off control is determined only by the standard under voltage lockout based upon the value of VCC, the lamp can extinguish long before the IC shuts down due to the limited operating range of the ballast lamp resonant output stage. This can result in catastrophic failure of the half-bridge MOSFETs or IGBTs. Furthermore, interaction between the ballast output stage and any active power factor control (PFC) stage at the input can give lamp flickering, hiccuping, reduced brightness and other undesirable effects depending on the configuration of the supply (VCC) for each stage and their corresponding shutdown sequence during under voltage. Also, depending on the type of protection logic present in the ballast circuitry, a fast transient on the AC line and/or DC bus (brown-out condition) can cause a fault to occur (i.e., lamp extinguishes and over-current is detected) forcing the ballast to latch off until a recycling of the line voltage or a lamp exchange is performed.

The circuitry in the ballast driver IC of the present invention provides the programmable on/off levels allowing the ballast to be shut down cleanly at a safe DC bus level before any fault conditions, undesirable load effects or failure of the half-bridge MOSFETS or IGBTs should occur.

Referring to the connection diagram of FIG. 2, when half-bridge output (VS) begins to oscillate, the charge pump circuit, comprised of capacitor 80 and diodes 82 and 84, supplies the IC of the present invention with the necessary supply current keeping VCC at the internal clamp voltage of 15.6 volts. In this configuration during running, the IC is no longer powered by the DC bus but by the ballast output stage. It is now independent of variations (to a certain degree) on the level of the DC bus. Should the DC bus decrease towards zero, the IC will continue to be supplied by the charge pump until VCC<9.5V, which occurs long after the lamp will have extinguished. In other words, in the absence of the DC bus/AC line on/off control circuitry of the present invention, the DC bus operating range of the ballast controller>>DC bus operating range of the ballast output stage. Should the lamp extinguish and the operating frequency remain fixed and below the resonance frequency of the ballast output stage before ignition, the MOSFETs (6 and 8) or IGBTs comprising the half-bridge can fail catastrophically due to high current spikes occurring at turn-on of either MOSFET (or either IGBT).

The on/off control circuit of the present invention, identified by the dashed lined block 90 in the block diagram of FIG. 3 consists of a window comparator, namely comparators 92 and 94, which compares a divided-down voltage from the DC bus against two internal threshold voltages, 5V and 3V, respectively. The 5V threshold is for rising and the 3V threshold is for falling. The difference between the two voltages translates into a hysteresis between on and off DC bus/AC line voltage levels to accommodate for AC ripple, transients and noise. Furthermore, should the DC bus be unregulated, it will change from the peak of the rectified line voltage before ignition to some lower value during running, depending on the power in the lamp. The hysteresis is sufficiently large that the reduction in DC bus level due to loading does not cause the ballast to shut off, which would result in a sustained hiccup.

The corresponding on and off DC bus/AC line thresholds are then programmed by correctly selecting resistors 96 and 98 which comprise a voltage divider which senses the DC bus. In addition to the UVLO circuit at VCC, the ballast controller will now wait until VCC>11.4V and VDC>5.1V.

The operation of the circuit is as follows: Initially, upon turn-on, when VDC exceeds 5V, the R (reset) input of RS latch 100 goes "high," causing the Q output of the latch to go low, thereby enabling the half-bridge driver (if all other inputs to OR gate 102 are also low). Should VDC fall below 3V, the S (set) input of RS latch 100 goes "high," causing the Q output of the latch to go "high" and therefore disabling the half-bridge driver.

In summary, the above-described DC bus/AC line on/off control circuit of the present invention provides the following advantageous design features:

1) A programmable means for turning the ballast on/off at pre-determined voltage levels of the DC bus depending on the operating range of the ballast output stage.
2) Allows for on/off control to be programmed as a function of the DC bus voltage level or the AC line level.
3) Eliminates potential danger of catastrophic destruction of the half-bridge MOSFETs or IGBTs due to below resonance operation upon the extinguishing of the lamp due to limited operating range of the ballast output stage.
4) Includes hysteresis to account for regulated and unregulated DC bus configurations and varying load conditions (i.e., pre-heat, ignition, no load.
5) Eliminates any undesirable lamp effects such as flickering, dimmed light level, hiccuping, etc., by turning on and off at adequate levels of DC bus voltage supplying the ballast output stage.

4. Over temperature Shutdown Circuit

In a fixed output (constant light) ballast, where the steady state operating frequency and bus voltage are relatively constant, the ambient temperature within the ballast can be sensed using an integrated circuit. This temperature sensing technique can therefore be used to protect the ballast from potentially hazardous over temperature conditions.

Since the junction temperature on the surface of the IC is directly related to the ambient temperature within the ballast, a thermal sensing circuit can be designed into the IC, and this sensing circuit can be used to protect the ballast from excessive ambient temperatures within the ballast enclosure. The exact temperature at which the ballast is shut down can easily be programmed by the IC manufacturer using a different metal mask within the IC manufacturing process, thus allowing ballast manufacturers to carefully tie the protection temperature to the particular construction and use for a given ballast design.

Figure 14:
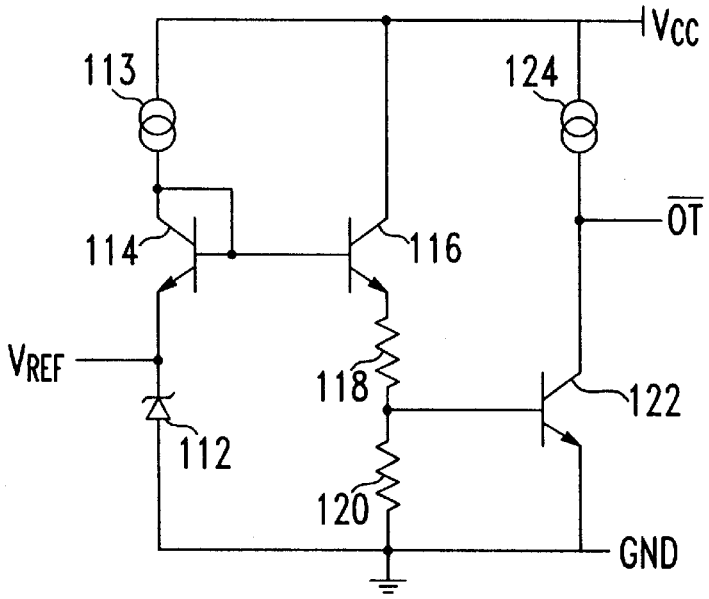
FIG. 14 illustrates a preferred embodiment of the temperature measurement circuit employed in the ballast driver IC of the present invention.

FIG. 14 illustrates a preferred embodiment of the temperature measurement circuit employed in the ballast driver IC of the present invention. The temperature measurement circuit is identified as overtemp block 110 in FIG. 3. Zener diode 112 represents a voltage reference within this circuit. Current source 113 provides this diode with a constant bias current, in order to maintain a constant voltage VREF at the emitter of transistor 114. Transistors 114 and 116 represent a buffer circuit, used to translate the VREF voltage to the emitter of transistor 116. Resistors 118 and 120 are used to set the voltage on the base of transistor 122, so that at temperatures below the shutdown temperature, transistor 122 is off. Because of the relationship between the Zener diode breakdown voltage and the temperature coefficient of that breakdown voltage, the temperature coefficient of the translated reference voltage (at the emitter of transistor 118) is either nearly zero or slightly positive. As an example, for a 5.15V Zener, the temperature coefficient (TC) is <1 mV/° C. For a 7.5V Zener, the TC is approximately 4 mV/° C. As a result, due to the divider formed by resistors 118 and 120, the temperature coefficient of the voltage on the base of transistor 122 is also near zero or slightly positive. However, at a constant current (e.g., 124 in FIG. 14), the VBE of transistor 122 has a negative TC of approximately −2 mV/° C. Thus, the divider ratio formed by resistors 118 and 120 can be chosen so that transistor 122 turns on at a specific temperature, signaling an over temperature (OT) condition at the OT node.

It will be appreciated by those of skill in the art that many different designs could be used to implement the temperature sensing and shutdown circuit of the present invention.

5. Circuit for Detecting Near or Below Resonance Operation

Under normal operating conditions, the phase of the inductor current (the current through inductor 130 (FIG. 2))

with respect to the half-bridge voltage VS lies somewhere between 0 and −90 degrees. Should the phase approach 0 degrees, however, the frequency is approaching resonance. At or near resonance, non-zero voltage switching can occur at the half-bridge, resulting in a large current spike at turn-on in either of the two half-bridge switches.

It is also possible for the resonant lamp output stage to be operating above the resonance frequency of the low-Q circuit (during running), but below the resonance frequency of the high-Q (before ignition) circuit. If the lamp is then removed, the transfer function jumps from the low-Q to the high-Q curve while the frequency remains unchanged and below the resonance frequency of the high-Q circuit. This results in almost immediate destruction of the half-bridge.

Another condition which can cause below resonance operation is if the filaments of the lamp are intact, but the gas within the lamp escapes (e.g., the glass cracks). In this condition, the load operating condition would instantaneously change from the damped (above resonance) to the undamped (below resonance).

The ballast IC driver of the present invention accordingly contains circuitry to detect for operation of the lamp near or below the resonance frequency, and to shutdown operation of the lamp under such conditions to prevent catastrophic failure of the switching devices (MOSFETs or IGBTs) of the half-bridge driver circuit.

The voltage across a sense resistor, (identified as resistor 132 in the typical connection diagram of FIG. 2) disposed either between the lower transistor switch and ground, or between the lower lamp filament and ground, is compared against a predetermined reference voltage to generate an output comparison signal. The output comparison signal is gated to the turn-off edge of lower MOSFET or IGBT 8 (in the case of the sense resistor disposed between lower transistor switch and ground) or to the turn-off edge of the upper MOSFET (in the case of the sense resistor between the lower lamp filament and ground) to generate a signal for shutting down the half-bridge circuit in the event of near or below resonance operation of the lamp resonant circuit.

Referring to the block diagram of FIG. 3, the near or below resonance detection circuit of the present invention comprises the components within the dashed lines identified by reference number 134. The near or below resonance detection circuit of the present invention senses the inductor current and compares it against a predetermined low-voltage threshold which is high enough in a dimming lamp so as not to interfere with the proper operation of the lamp, but not so high that it signals a fault condition unnecessarily far above the resonant frequency.

More specifically, in the circuit of the present invention, the inductor current is sensed as shown in the typical connection circuit of FIG. 2, with resistor 132 disposed between the source of the lower half-bridge MOSFET or IGBT 8 of the driver circuit and ground. The sensed voltage is applied to the CS input of the ballast driver IC of the present invention.

Referring now to the block diagram of FIG. 3, and more specifically to the circuitry 134 within the dashed lines, the CS input representing the voltage across resistor 132 is compared against a reference voltage (e.g., 0.2V as shown in FIG. 3) by a comparator 136, and the output of comparator 136 is then gated to the turn-off edge of the gate signal for the low side MOSFET or IGBT 8. In the preferred embodiment of the invention shown in FIG. 3, this gating is accomplished using a D-type Flip Flop 140.

If the voltage across sense resistor 132 falls below the lower-voltage threshold (0.2V) at the turn-off of low side MOSFET or IGBT 8, indicative of the phase angle of the inductor 130 current with respect to the half-bridge voltage approaching zero and therefore the operating frequency near or below the resonance frequency of the output stage, the Q-output of D-type flip flop 140 goes low, driving the output of RS latch 36 high, and the half-bridge circuit is latched off.

The near or below resonance operation detection is performed by the circuit of the present invention on a cycle-by-cycle basis, so shutdown occurs almost immediately. This is important for load removal, when the transfer function changes abruptly from above resonance to below resonance and the half-bridge should be shut down within the next cycle of fault occurrence.

6. Non Zero-Voltage Switching Protection Circuit

When driving a resonant load with a high and low side half-bridge driver circuit, it is necessary to fulfill zero-voltage switching. This ensures smooth AC currents and voltages and provides a continuous uninterrupted inductor current. Should non zero-voltage switching occur while driving a fluorescent lamp with a resonant output stage, high current spikes appear in the half-bridge switches, which can exceed the maximum current ratings of the switches and/or the resulting power losses in the switches can cause the switches to thermally destruct.

Non zero-voltage switching can occur due to one or both lamp filaments breaking, resulting in an open-circuit or a normal running lamp but a decreasing DC bus voltage. In each case, the half-bridge output voltage, $V_S$, must commutate to zero volts before the lower switch turns on or must commutate to the DC bus voltage before the upper switch turns on. If no lamp is present, no inductor current flows to commutate the capacitance from $V_S$ to ground due to the switch and (if present) the snubber capacitor 80. The circuit of the present invention senses the resulting current spike and turns both half-bridge switches off if it exceeds a predetermined value.

The protection circuit of the present invention senses the current spike indicative of a non zero voltage-switching condition via sense resistor 132 disposed between the lower half bridge switch and ground. The sense resistor 132 develops a voltage across it which corresponds to the current flowing through the lower switch. This voltage is applied to the CS input of the ballast driver IC of the present invention as shown in FIG. 2.

Referring now to the block diagram of FIG. 3, the voltage at the CS input pin is applied to the non zero-voltage switching circuitry of the present invention, which comprises the circuitry within the dashed line identified by reference number 150. More specifically, the voltage across the sense resistor (i.e., the voltage at the CS input pin) is compared against a fixed threshold voltage (1.0V in the preferred embodiment of the invention) with comparator 152. Should the voltage across the sense resistor exceed 1.0V in the event of non zero-voltage switching condition, the RS-latch 36 is set by the output of comparator 152 going "high," and therefore shutting down the gate drive signals through the reset inputs of RS latch 36 and toggle flip flop 20. The upper and lower MOSFETs or IGBTs 6 and 8 are then latched in tri-state mode (both off). The circuit remains in this disabled mode until the under voltage detect circuit 40 cycles from a low to a high to a low again due to a recycling of circuit supply voltage VCC, or, the reset input to OR gate 160 is cycled from a low to a high to a low due to a lamp removal and re-insertion.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An integrated circuit for driving first and second MOS gated power transistors which are connected in a half bridge arrangement for supplying an oscillating current to power a fluorescent lamp through a lamp resonant circuit, the integrated circuit comprising circuitry for automatically switching between at least the following plurality of modes of operation in accordance with a state diagram in which the mode of operation is determined based upon the status of various inputs to the integrated circuit indicating the integrated circuit supply voltage, driver frequency, lamp fault or lamp exchange condition, DC bus voltage, and integrated circuit temperature, the plurality of modes of operation including:

1) an under voltage lockout mode;

2) a preheat mode;

3) an ignition ramp mode;

4) a run mode; and 5) a fault mode, wherein the integrated circuit switches sequentially after power on from the under voltage lockout mode to the preheat mode, then to the ignition ramp mode, and then to the run mode under normal operating conditions; and wherein the integrated circuit switches from the preheat mode, the ignition ramp mode, or the run mode to the under voltage lockout mode in the presence of a fault condition selected from the group consisting of insufficient integrated circuit supply voltage, insufficient DC bus voltage, and absence of a lamp; and wherein the integrated circuit switches:

from the preheat mode to the fault mode when the temperature of the integrated circuit exceeds an over temperature condition;

from the ignition ramp mode to the fault mode when the temperature of the integrated circuit exceeds an over temperature condition, the lamp fails to strike or hard switching of the first and second MOS gated power transistors occurs; and from the run mode to the fault mode when the temperature of the integrated circuit exceeds an over temperature condition, the lamp fails to strike or hard switching of the first and second MOS sated power transistors occurs, when the resonance frequency of the lamp resonant circuit is below a preset minimum, or a no load condition is present.

2. The integrated circuit of claim 1, wherein the integrated circuit switches from the under voltage mode to the preheat mode when the integrated circuit supply voltage is greater than an under voltage lockout value, the DC bus voltage is greater than a predetermined value, the presence of a lamp is detected, and the temperature of the integrated circuit is below a predetermined temperature.

3. The integrated circuit of claim 1, wherein the integrated circuit switches from the preheat mode to the ignition ramp mode in the absence of any fault conditions after a predetermined preheat time.

4. The integrated circuit of claim 1, wherein the integrated circuit switches from the ignition ramp mode to the run mode in the absence of any fault conditions upon completion of a ramp-up in voltage to a running voltage.

5. The integrated circuit of claim 1, further comprising circuitry for detecting the occurrence of non zero-voltage switching and for shutting down the supply of oscillating current to the fluorescent lamp upon such occurrence.

6. The integrated circuit of claim 1, further comprising circuitry for detecting the occurrence of near or below resonance operation of the fluorescent lamp and for shutting down the supply of oscillating current to the fluorescent lamp upon such occurrence.

7. The integrated circuit of claim 1, further comprising circuitry for detecting the occurrence of an over temperature condition of the integrated circuit and for shutting down the supply of oscillating current to the fluorescent lamp upon such occurrence.

8. The integrated circuit of claim 1, further comprising circuitry for detecting a fault in the DC bus or AC line voltage and for shutting down the supply of oscillating current to the fluorescent lamp upon such occurrence.

9. The integrated circuit of claim 1, further comprising circuitry for preventing the voltage across the lamp during the preheat mode from exceeding the strike voltage to ensure a flash-free start.

10. The integrated circuit of claim 9, wherein the circuitry for preventing the voltage across the lamp during the preheat mode from exceeding the strike voltage to ensure a flash-free start comprises circuitry for temporarily raising the frequency of the oscillating current supplied to the lamp during the initial portion of the preheat mode.

11. The integrated circuit of claim 9, wherein the circuitry for preventing the voltage across the lamp during the preheat mode from exceeding the strike voltage to ensure a flash-free start comprises circuitry for initially delaying the supply of oscillating current to the lamp during the beginning of the preheat mode until a timing capacitor is partially charged to ensure equal length gate pulses to the half bridge power transistors from the start.

12. A method for driving first and second MOS gated power transistors which are connected in a half bridge arrangement supplying an oscillating current to power a fluorescent lamp through a lamp resonant circuit, the method comprising switching an integrated circuit automatically between at least the following plurality of modes of operation in accordance with a state diagram in which the mode of operation is determined based upon the status of various inputs to the integrated circuit indicating the integrated circuit supply voltage, driver frequency, lamp fault or lamp exchange condition, DC bus voltage, and integrated circuit temperature, the plurality of modes of operation including:

1) an under voltage lockout mode;

2) a preheat mode;

3) an ignition ramp mode;

4) a run mode; and 5) a fault mode, wherein the switching takes place sequentially after power on from the under voltage lockout mode to the preheat mode, then to the ignition ramp mode, and then to the run mode under normal operating conditions; and wherein switching from the preheat mode, the ignition ramp mode, or the run mode to either the under voltage lockout mode or the fault mode occurs in response to a change in status of inputs to the integrated circuit indicating an abnormal condition, such that the integrated circuit switches from the preheat mode, the ignition ramp mode, or the run mode to the under voltage lockout mode in the presence of a fault condition selected from the group consisting of insufficient integrated circuit supply voltage, insufficient DC bus voltage, and absence of a lamp; and the integrated circuit switches from the preheat mode to the fault mode when the temperature of the integrated circuit exceeds an over temperature condition; from the ignition ramp mode to the fault mode when the temperature of the integrated circuit exceeds an over temperature condition, the lamp fails to strike or hard switching of the first and second MOS gated power transistors occurs; and from the run mode to the fault mode when the temperature of the integrated circuit exceeds an over temperature condition, the lamp fails to strike or hard switching of the first and second MOS gated power transistors occurs, when the resonance frequency of the lamp resonant circuit is below a preset minimum, or a no load condition is present.

* * * * *